US005624211A

United States Patent [19]

Anderson et al.

[11] Patent Number: 5,624,211

[45] Date of Patent: *Apr. 29, 1997

[54] MODULAR BLOCK RETAINING WALL CONSTRUCTION AND COMPONENTS

[75] Inventors: Peter L. Anderson, North Reading, Mass.; Michael J. Cowell, Leesburg; Dan J. Hotek, Reston, both of Va.

[73] Assignee: Societe Civile Des Brevets Henri C. Vidal, France

[ * ] Notice: The term of this patent shall not extend beyond the expiration date of Pat. No. 5,487,623.

[21] Appl. No.: 192,801

[22] Filed: Feb. 14, 1994

Related U.S. Application Data

[63] Continuation-in-part of Ser. No. 40,904, Mar. 31, 1993, and Ser. No. 108,933, Aug. 18, 1993.

[51] Int. Cl.[6] ..... E02D 29/02

[52] U.S. Cl. ..... 405/286; 405/262; 405/284

[58] Field of Search ..... 405/262, 284, 405/285, 286

[56] References Cited

U.S. PATENT DOCUMENTS

| | | | |
|---|---|---|---|
| D. 95,788 | 5/1988 | Forsberg | D25/113 |
| 126,547 | 5/1872 | Hickcox . | |
| 228,052 | 5/1880 | Frost . | |
| D. 237,704 | 11/1975 | Lane | D18/2 |
| D. 295,790 | 5/1988 | Forsberg | D25/116 |
| D. 296,007 | 5/1988 | Forsberg | D25/116 |
| D. 296,365 | 6/1988 | Forsberg | D25/116 |
| D. 297,464 | 8/1988 | Forsberg | D25/114 |
| D. 297,574 | 9/1988 | Forsberg | D25/114 |
| D. 297,767 | 9/1988 | Forsberg | D25/58 |
| D. 298,463 | 11/1988 | Forsberg | D25/114 |
| D. 299,067 | 12/1988 | Forsberg | D25/58 |
| D. 300,253 | 3/1989 | Forsberg | D25/114 |
| D. 300,254 | 3/1989 | Forsberg | D25/114 |
| D. 301,064 | 5/1989 | Forsberg | D25/116 |

(List continued on next page.)

FOREIGN PATENT DOCUMENTS

| | | |
|---|---|---|
| 2031077 | 5/1991 | Canada . |
| 0079880 | 5/1983 | European Pat. Off. . |
| 0047717 | 6/1983 | European Pat. Off. . |
| 0047718 | 5/1984 | European Pat. Off. . |
| 0170113 | 2/1986 | European Pat. Off. . |
| 0212357 | 3/1987 | European Pat. Off. . |
| 0430890A1 | 6/1991 | European Pat. Off. . |
| 0472993 | 3/1992 | European Pat. Off. . |
| 392474 | 11/1908 | France . |
| 1360872 | 4/1963 | France . |
| 2216823 | 8/1974 | France . |
| 7528079 | 9/1975 | France . |
| 2367147 | 5/1978 | France . |
| 2414202 | 10/1975 | Germany . |
| 2944550 | 9/1981 | Germany . |
| 3401629A1 | 7/1984 | Germany . |
| 4103330 | 9/1991 | Germany . |
| 586016 | 9/1981 | Japan . |
| 84735 | 6/1920 | Sweden . |

OTHER PUBLICATIONS

AASHTO–AGC–ARTBA Joint Committee, Subcommittee On New Highway Materials, Task force 27 Report "In Situ Soil Improvement Techniques" (Undated).

Silifrance Product Information Sheet (Undated).

Besser Co. "The Beauty of Concrete Block" (Undated).

Rockwood Classic Retaining Wall System Product Information Sheet (Undated).

(List continued on next page.)

*Primary Examiner*—Tamara L. Graysay
*Assistant Examiner*—Frederick L. Lagman
*Attorney, Agent, or Firm*—Banner & Allegretti, Ltd.

[57] ABSTRACT

A modular block wall includes dry cast, unreinforced modular wall blocks with anchor type, or frictional type or composite type soil stabilizing elements recessed therein and attached thereto by vertical rods which also connect the blocks together. The soil stabilizing elements are positioned in counterbores or slots in the blocks and project into the compacted soil behind the courses of modular wall blocks.

34 Claims, 27 Drawing Sheets

U.S. PATENT DOCUMENTS

| | | | |
|---|---|---|---|
| D. 311,444 | 10/1990 | Forsberg | D25/113 |
| D. 317,048 | 5/1991 | Forsberg | D25/114 |
| 566,924 | 9/1896 | Morrin . | |
| 810,748 | 1/1906 | Haller et al. . | |
| 1,092,621 | 4/1914 | Worner . | |
| 1,414,444 | 5/1922 | Straight . | |
| 1,456,498 | 5/1923 | Binns . | |
| 1,818,416 | 8/1931 | Meara . | |
| 2,235,646 | 3/1941 | Schaffer | 72/101 |
| 2,252,155 | 8/1941 | Baldwin | 72/103 |
| 2,313,363 | 3/1943 | Schmitt . | |
| 2,882,689 | 4/1959 | Huch et al. | 61/35 |
| 2,963,828 | 12/1960 | Belliveau | 50/425 |
| 3,036,407 | 5/1962 | Dixon | 50/443 |
| 3,252,287 | 5/1966 | Suzuki | 61/5 |
| 3,274,742 | 9/1966 | Paul, Jr. et al. | 52/245 |
| 3,332,187 | 7/1967 | Arcari | 52/309 |
| 3,390,502 | 7/1968 | Carroll | 52/424 |
| 3,430,404 | 3/1969 | Muse | 52/439 |
| 3,557,505 | 1/1971 | Kaul | 52/275 |
| 3,686,873 | 8/1972 | Vidal | 61/39 |
| 3,936,987 | 2/1976 | Calvin | 52/309 |
| 3,995,434 | 12/1976 | Kato et al. | 61/4 |
| 3,998,022 | 12/1976 | Muse | 52/574 |
| 4,016,693 | 4/1977 | Warren | 52/405 |
| 4,110,949 | 9/1978 | Cambiuzzi et al. | 52/437 |
| 4,116,010 | 9/1978 | Vidal | 405/262 |
| 4,207,718 | 6/1980 | Schaaf et al. | 52/585 |
| 4,208,850 | 6/1980 | Collier | 52/285 |
| 4,228,628 | 10/1980 | Schlomann | 52/438 |
| 4,229,123 | 10/1980 | Heinzmann | 405/273 |
| 4,312,606 | 1/1982 | Sarikelle | 405/286 |
| 4,324,508 | 4/1982 | Hilfiker et al. | 405/284 |
| 4,335,549 | 6/1982 | Dean, Jr. | 52/98 |
| 4,449,857 | 5/1984 | Davis | 405/286 |
| 4,454,699 | 6/1984 | Strobl | 52/585 |
| 4,470,728 | 9/1984 | Broadbent | 405/284 |
| 4,496,266 | 1/1985 | Ruckstuhl | 404/41 |
| 4,524,551 | 6/1985 | Scheiwiller | 52/98 |
| 4,572,699 | 2/1986 | Rinninger | 404/42 |
| 4,725,170 | 2/1988 | Davis | 405/286 |
| 4,802,320 | 2/1989 | Forsberg | 52/585 |
| 4,825,619 | 5/1989 | Forsberg | 52/562 |
| 4,909,010 | 3/1990 | Gravier | 52/609 |
| 4,914,876 | 4/1990 | Forsberg | 52/169.4 |
| 4,998,397 | 3/1991 | Orton | 52/715 |
| 5,004,376 | 4/1991 | Vidal et al. | 405/284 |
| 5,091,247 | 2/1992 | Willibey et al. | 428/255 |

FOREIGN PATENT DOCUMENTS

| | | |
|---|---|---|
| 205452 | 9/1939 | Sweden . |
| 27174 | of 1930 | U.S.S.R. . |
| 894038 | 12/1981 | U.S.S.R. . |
| 1090803A | 5/1984 | U.S.S.R. . |
| 336 | of 1871 | United Kingdom . |
| 14528 | of 1913 | United Kingdom . |
| 1385207 | 2/1975 | United Kingdom . |
| 2014222 | 11/1979 | United Kingdom . |
| 2127872 | 4/1984 | United Kingdom . |
| 383156103 | 11/1992 | United Kingdom . |

OTHER PUBLICATIONS

Earthworks™ Retaining Wall System Product Information Sheet (Undated).

EarthStone™ Erosion Control/Retaining Wall System Product Information Sheet (Undated).

Rockwood Retaining Walls, Inc. Product Information Sheet (Undated).

RISI Stone Retaining Wall Systems "Preserving Our Environment" Information Brochure (1976).

Reinforced Earth Co.® "Design of Live Storage Structures Using Reinforced Earth®" (1983).

Reinforced Earth Co.® "Industrial Applications of Reinforced Earth® Structures" (1988).

Versa–Lok® Retaining Wall Systems Information Brochure (1989).

Structural Block Systems, Inc. "Introducing Radial Block" (1990).

Allan Block™ Retaining Walls "A Mortarless, Stackable Concrete Block Retaining Wall System" (1990).

Interim, Highway Bridges, Division I—Design, 5.8.7.2 "Polymeric Reinforcements" (1991).

Westblock Products, Inc. "GravityStone™" (1992).

Genesis™ Highway Wall System (1992).

Hunziker "Cobra" (1992).

Keystone™ Retaining Wall Systems "Standard Unit" (1993).

Keystone™ Retaining Wall Systems "Mini and Cap Unit" (1993).

Publication "Modular Concrete Block" (1984).

Publication "Paving Stone: A New Look with Old World Charm" (1984).

Publication "Methods of Making Split Corners" (1985).

Hollow Building Assoc. Handbook "Standard Load–Bearing Wall Tile" (1924).

Concrete Masonry Pictorial, vol. 33, No. 3, c. 1977 p. 5.

The Contractor, vol. 2 No. 9, Oct. 1987, pp. 13–16.

Tensar Concrete GeoWall Brochure (1986).

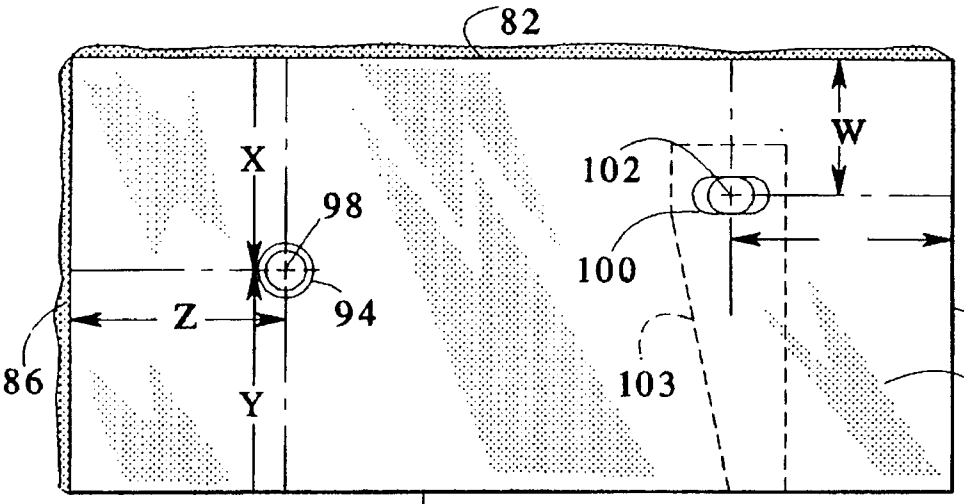
FIG. 8
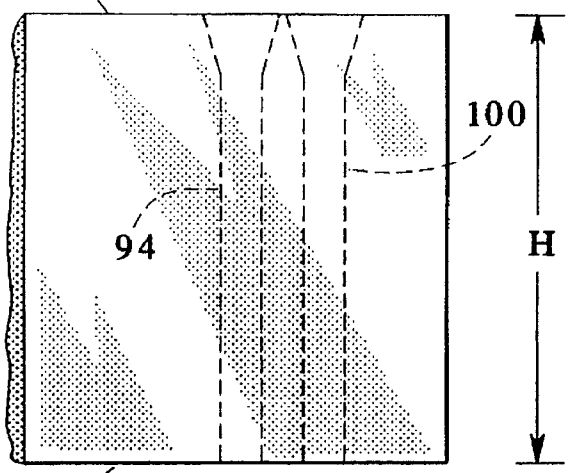
FIG. 9
FIG. 10

80
182
94
185
80
103
80
80
100

40
40
50

72
40
75
40
70
70
72

94
100
80
82
85
94
80
100

80
82
80
85
80
80

94
80
100
80

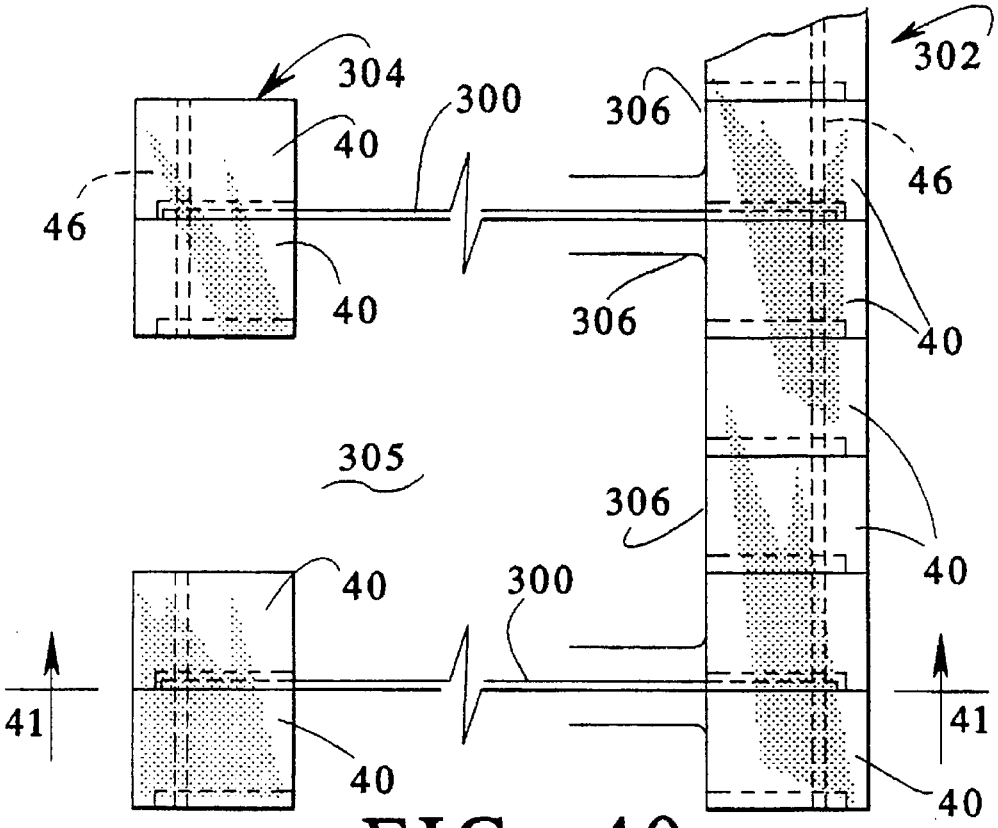
FIG. 40
FIG. 13A
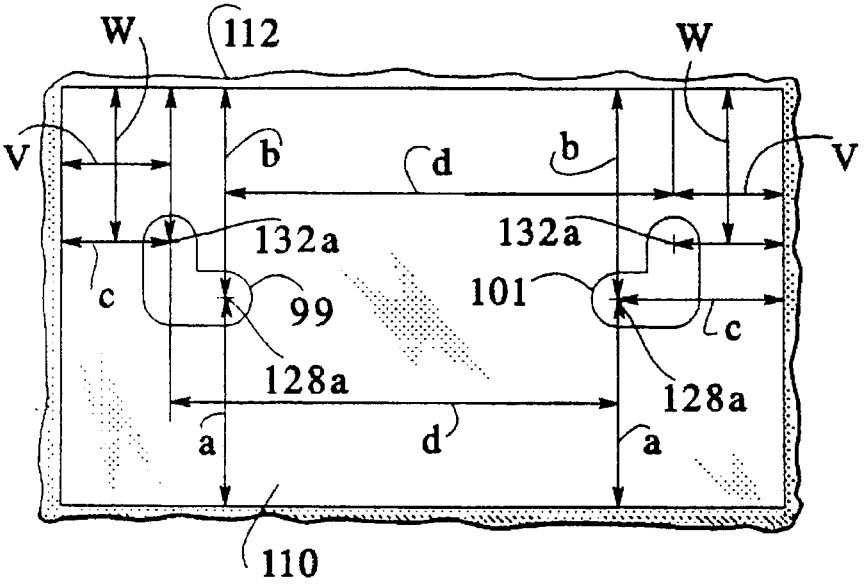

FIG. 47
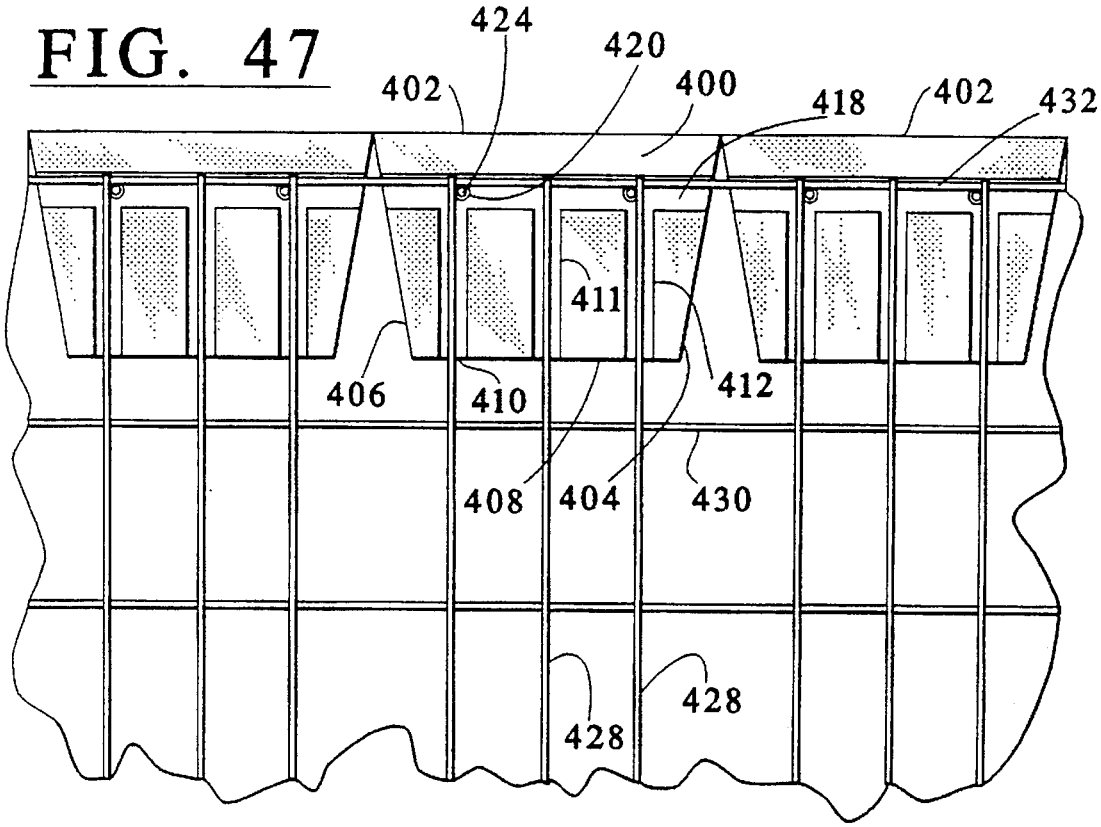
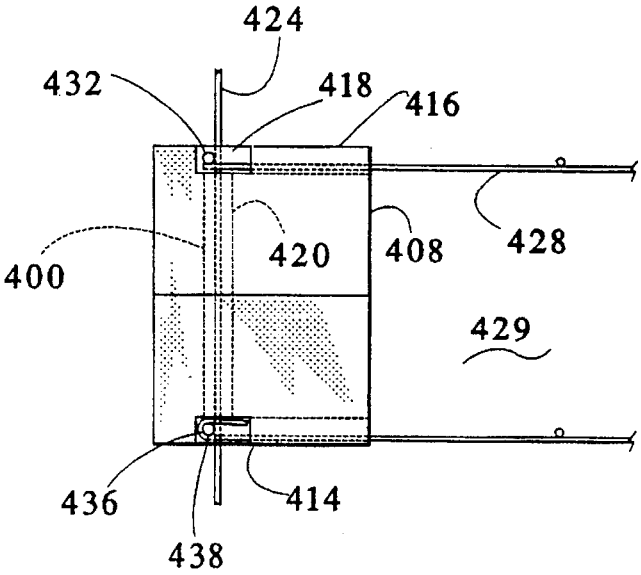
FIG. 48

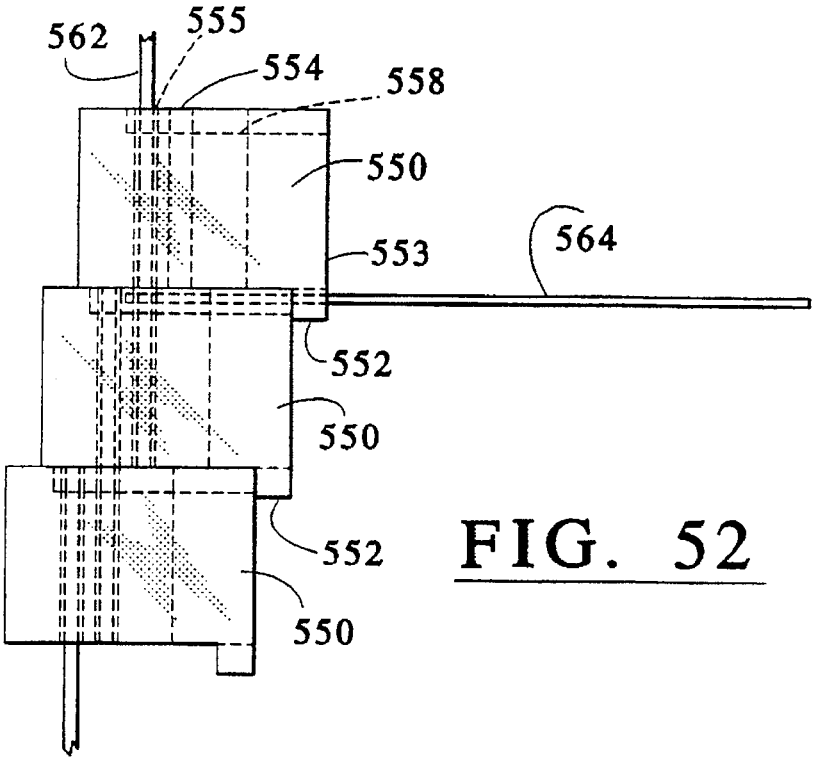
FIG. 52
FIG. 53
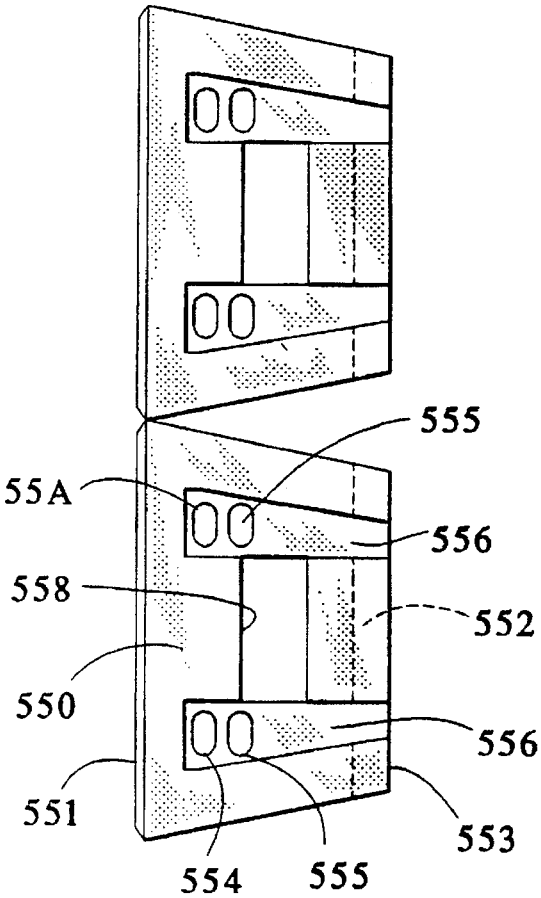

MODULAR BLOCK RETAINING WALL CONSTRUCTION AND COMPONENTS

CROSS REFERENCE TO RELATED APPLICATION

This is a continuation-in-part application to U.S. Ser. No. 08/040,904, filed Mar. 31, 1993 for Modular Block Retaining Wall Construction and Components and to U.S. Ser. No. 08/108,933, filed Aug. 18, 1993 for Modular Block Retaining Wall Construction and Components for which priority is claimed.

BACKGROUND OF THE INVENTION

This invention relates to an improved retaining wall construction and, more particularly, to a retaining wall construction comprised of modular blocks, in combination with tie-back and/or mechanically stabilized earth elements and compacted particulate or soil.

In U.S. Pat. No. 3,686,873 and U.S. Pat. No. 3,421,326, Henri Vidal discloses a constructional work now often referred to as a mechanically stabilized earth structure. The referenced patents also disclose methods for construction of mechanically stabilized earth structures such as retaining walls, embankment walls, platforms, foundations, etc. In a typical Vidal construction, particulate earthen material interacts with longitudinal elements such as elongated steel strips positioned at appropriately spaced intervals in the earthen material. The elements are generally arrayed for attachment to reinforced precast concrete wall panels and, the combination forms a cohesive embankment and wall construction. The longitudinal elements, which extend into the earthen work, interact with compacted soil particles principally by frictional interaction and thus mechanically stabilize the earthen work. The longitudinal elements may also perform a tie-back or anchor function.

Various embodiments of the Vidal development have been commercially available under various trademarks including the trademarks, REINFORCED EARTH embankments and RETAINED EARTH embankments. Moreover, other constructional works of this general nature have been developed. By way of example and not by way of limitation, Hilfiker in U.S. Pat. No. 4,324,508 discloses a retaining wall comprised of elongated panel members with wire grid mats attached to the backside of the panel members projecting into an earthen mass.

Vidal, Hilfiker and others generally disclose large precast, reinforced concrete wall panel members cooperative with strips, mats, etc. to provide a mechanically stabilized earth construction. Vidal, Hilfiker and others also disclose or use various shapes of wall panel members. It is also noted that in constructions disclosed by Vidal and Hilfiker, the elements interactive with the compacted earth or particulate behind the wall panels or blocks, are typically rigid steel strips or mats which rely upon friction and/or anchoring interaction with the particulate, although ultimately, all interaction between such elements and the earth or particulate is dependent upon friction.

It is sometimes difficult or not practical to work with large panel members like those disclosed in Vidal or Hilfiker inasmuch as heavy mechanical lifting equipment is often required to position such panels. In such circumstances, smaller blocks rather than panels may be used to define the wall. Forsberg in U.S. Pat. No. 4,914,876 discloses the use of smaller retaining wall blocks in combination with flexible plastic netting as a mechanically stabilizing earth element to thereby provide a mechanically stabilized earth retaining wall construction. Using flexible plastic netting and smaller, specially constructed blocks arranged in rows superimposed one upon the other, reduces the necessity for large or heavy mechanical lifting equipment during the construction phase of such a wall.

Others have also suggested the utilization of facing blocks of various configurations with concrete anchoring and/or frictional netting material to build an embankment and wall. Among the various products of this type commercially available is a product offered by Rockwood Retaining Walls, Inc. of Rochester, Minn. and a product offered by Westblock Products, Inc. and sold under the tradename, Gravity Stone. Common features of these systems appear to be the utilization of various facing elements in combination with backfill, wherein the backfill is interactive with plastic or fabric reinforcing and/or anchoring means which are attached to the facing elements. Thus, there is a great diversity of such combinations available in the marketplace or disclosed in various patents and other references.

Nonetheless, there has remained the need to provide an improved system utilizing anchoring and/or frictional interaction of backfill and elements positioned in the backfill wherein the elements are cooperative with and attachable to facing elements, particularly blocks which are smaller and lighter than large facing panels such as utilized in many installations. The present invention comprises an improved combination of elements of this general nature and provides enhanced versatility in the erection of retaining walls and embankments, as well as in the maintenance and cost of such structures.

SUMMARY OF THE INVENTION

Briefly, the present invention comprises a combination of components to provide an improved retaining wall system or construction. The invention also comprises components or elements from which the improved retaining wall is fabricated. An important feature of the invention is a modular wall block which is used as a facing component for the retaining wall construction. The modular wall block may be unreinforced and dry cast. The block includes a front face which is generally planar, but may be configured in almost any desired finish and shape. The wall block also includes generally converging side walls, generally parallel top and bottom surfaces, a back wall, vertical throughbores or passages through the block specially positioned to enhance the modular character of the block, and counterbores associated with the throughbores having a particular shape and configuration which permit the block to be integrated with and cooperative with various types of anchoring and/or earth stabilizing elements. Special corner block and cap block constructions are also disclosed.

Various earth stabilizing and/or anchor elements are also disclosed for cooperation with the modular wall or face block and other blocks. A preferred embodiment of the earth stabilizing and/or anchoring elements includes first and second generally parallel tensile rods which are designed to extend longitudinally from the modular wall block into compacted soil or an earthen work. The ends of the tensile rods are configured to fit within the counterbores defined in the top or bottom surface of the modular wall or facing block. Angled or transverse cross members connect the parallel tensile rods and are arrayed not only to enhance the anchoring characteristics, but also the frictional characteristics of interaction of the tensile rods with earth or particulate material comprising the embankment. The described wall construction further includes generally vertical anchoring rods that interact both with the stabilizing elements and also with the described modular blocks by extending vertically through the throughbores in those blocks while simultaneously engaging the stabilizing elements.

An alternative stabilizing element cooperative with the modular blocks comprises a harness which includes generally parallel tension arms that fit into the counterbores in the blocks and which cooperate with the vertical anchoring rods so as to attach the tension arms to the blocks. The harness includes a cross member connecting the opposite tension arms adjacent the back face outside of the modular block. The cross member of the harness may be cooperative with a geotextile strip, for example, which extends into the earthen work behind the modular wall block. Again, the harness cooperates with vertical anchoring rods which extend into the passages or throughbores defined in the modular blocks. Various other alternative permutations, combinations and constructions of the described components are set forth.

Thus it is an object of the invention to provide an improved retaining wall construction comprised of modular blocks and cooperative stabilizing elements that project into an earthen work or particulate material.

It is a further object of the invention to provide an improved and unique modular block construction for utilization in the construction of a improved retaining wall construction.

Yet another object of the invention is to provide a modular block construction which may be easily fabricated utilizing known casting or molding techniques.

Yet a further object of the invention is to provide a substantially universal modular wall block which is useful in combination with earth retaining or stabilizing elements as well as anchoring elements.

Yet another object of the invention is to provide unique earth anchoring and/or stabilizing elements that are cooperative with a modular wall or facing block.

Yet a further object of the invention is to provide a combination of components for manufacture of a retaining wall system or construction which is inexpensive, efficient, easy to use and which may be used in designs susceptible to conventional design or engineering techniques.

Another object of the invention is to provide a design for a modular block which may be used in a mechanically stabilized earth construction or an anchor wall construction wherein the block may be unreinforced and/or manufactured by dry cast or pre-cast methods, and/or interactive with rigid, metal stabilizing elements as well as flexible stabilizing elements such as geotextiles.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 8 is a top plan view of a corner block as contrasted with the wall block of FIG. 5;

FIG. 9 is a rear elevation of the block of FIG. 8;

FIG. 10 is a side elevation of the block of FIG. 8;

FIG. 13A is a top plan view of an alternate throughbore pattern for a corner block;

FIG. 40 is a side elevation of an alternative wall construction utilizing anchor type stabilizing elements;

FIG. 46 is a cross-sectional view of the alternative cap block construction of

FIG. 45 taken along the line 46—46.

FIG. 47 is a sectional plan view of an alternative construction incorporating modular facing blocks and a rigid grid;

FIG. 48 is a side sectional view of the construction of FIG. 47;

FIG. 52 is a side sectional view of a further alternative to the construction of FIG. 50 depicting an alternative facing block construction;

FIG. 53 is a top sectional view of the construction of FIG. 52;

DESCRIPTION OF THE PREFERRED EMBODIMENTS

General Description

Figure 1:
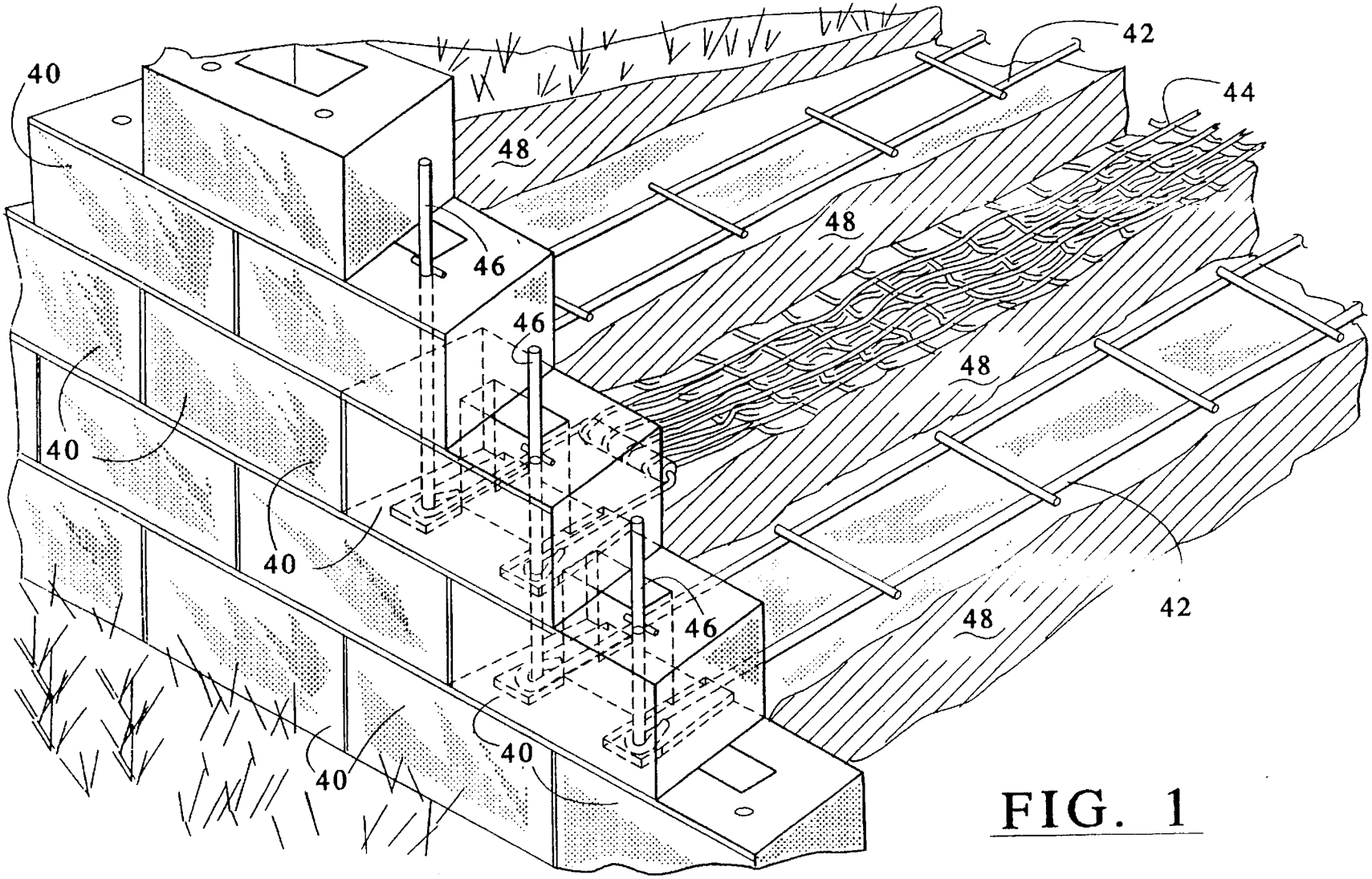
FIG. 1 is an isometric, cut away view of an embodiment and example of the modular block retaining wall construction of the invention incorporating various alternative elements or components.
Figure 3:
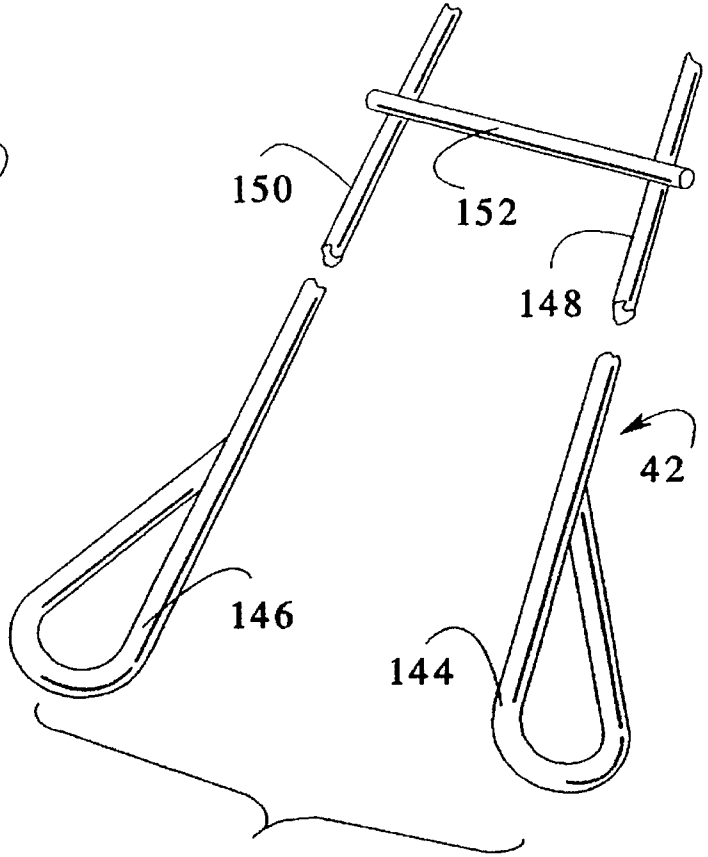
FIG. 3 is an isometric view of an earthen stabilizing and/or anchor element which is used in combination with the modular block of FIG. 2 and which cooperates with and interacts with earth or particulate by means of friction and/or anchoring means or both.

FIG. 1 generally depicts the combination of components or elements which define the modular block retaining wall construction of the invention. Modular blocks 40 are arranged in courses one upon the other in an overlapping array. Generally rigid earth retaining or stabilizing elements 42 and/or flexible stabilizing elements 44 are cooperative with or interact with the blocks 40. Also, anchoring elements such as tie back elements may be utilized in cooperation with blocks 40. The stabilizing or anchoring elements 42, 44 are attached to blocks 40 by means of vertical anchoring rods 46. The elements 42 and/or 44 project from the back face of blocks 40 into compacted soil 48 and interact with the soil 48 as anchors and/or frictionally.

It is noted that interaction between the elements 42 and 44 and soil or particulate 48 depends ultimately upon frictional interaction of particulate material comprising the soil 48 with itself and with elements, such as elements 42 and 44. Conventionally, that interaction may be viewed as an anchoring interaction in many instances rather than a frictional interaction. Thus, for purposes of the disclosure of the present invention, both frictional and anchoring types of interaction of compacted soil 48 with stabilizing and/or anchor elements are considered to be generally within the scope of the invention.

The invention comprises a combination of the described components including the blocks 40, stabilizing elements 42 and/or 44, anchoring rods 46 and soil 48 as well as the separate described components themselves, the method of assembly thereof, the method of manufacture of the separate components and various ancillary or alternative elements and their combination. Following is a description of these various components, combinations and methods.

Facing Block Construction

Figure 2:
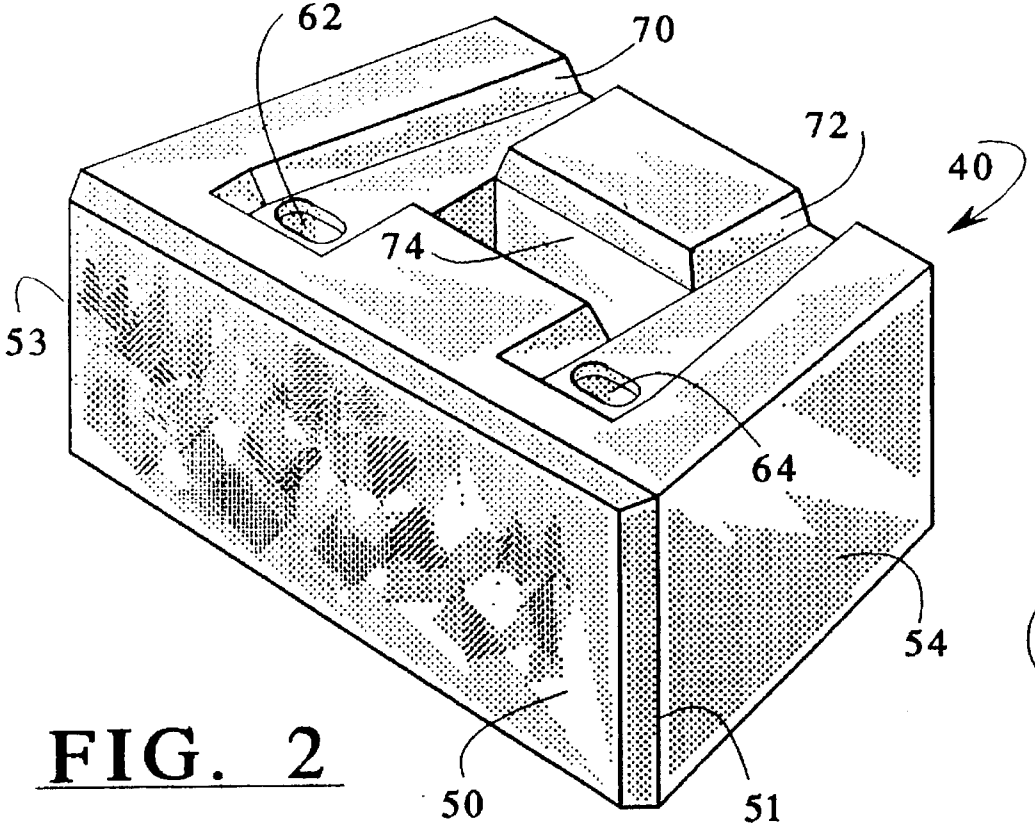
FIG. 2 is an isometric view of the improved standard modular wall block utilized in the retaining wall construction of the invention.
Figure 7:
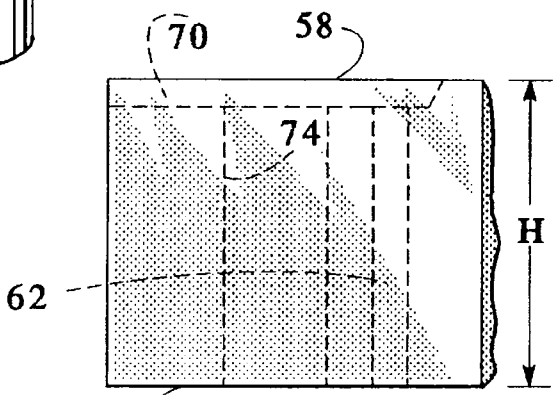
FIG. 7 is a side elevation of the block of FIG. 5.
Figure 5:
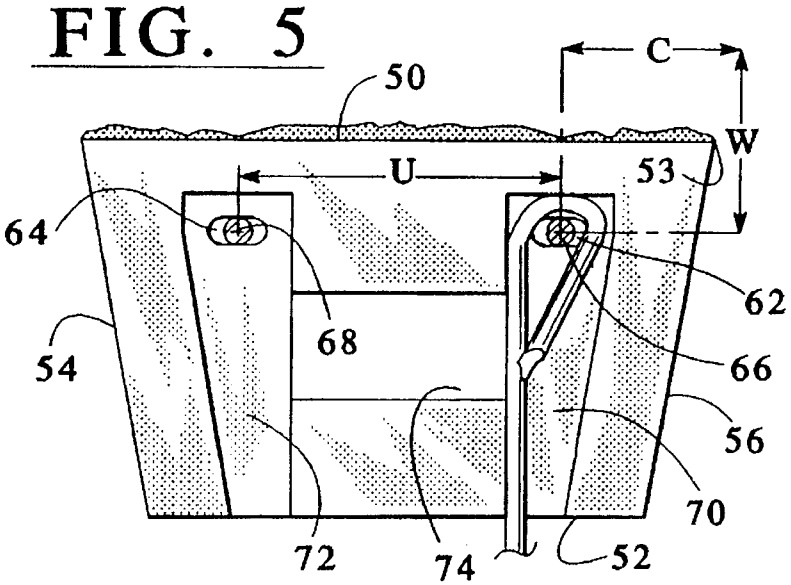
FIG. 5 is a bottom plan view of the block of FIG. 2.
Figure 6:
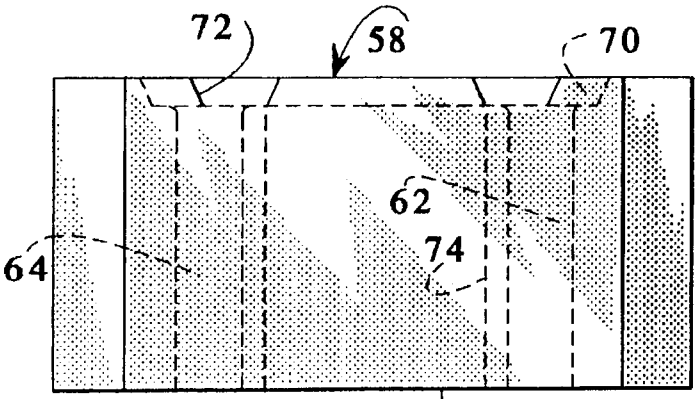
FIG. 6 is a rear elevation of the block of FIG. 5.
Figures 30, 31, 32, 33, 34, 35:
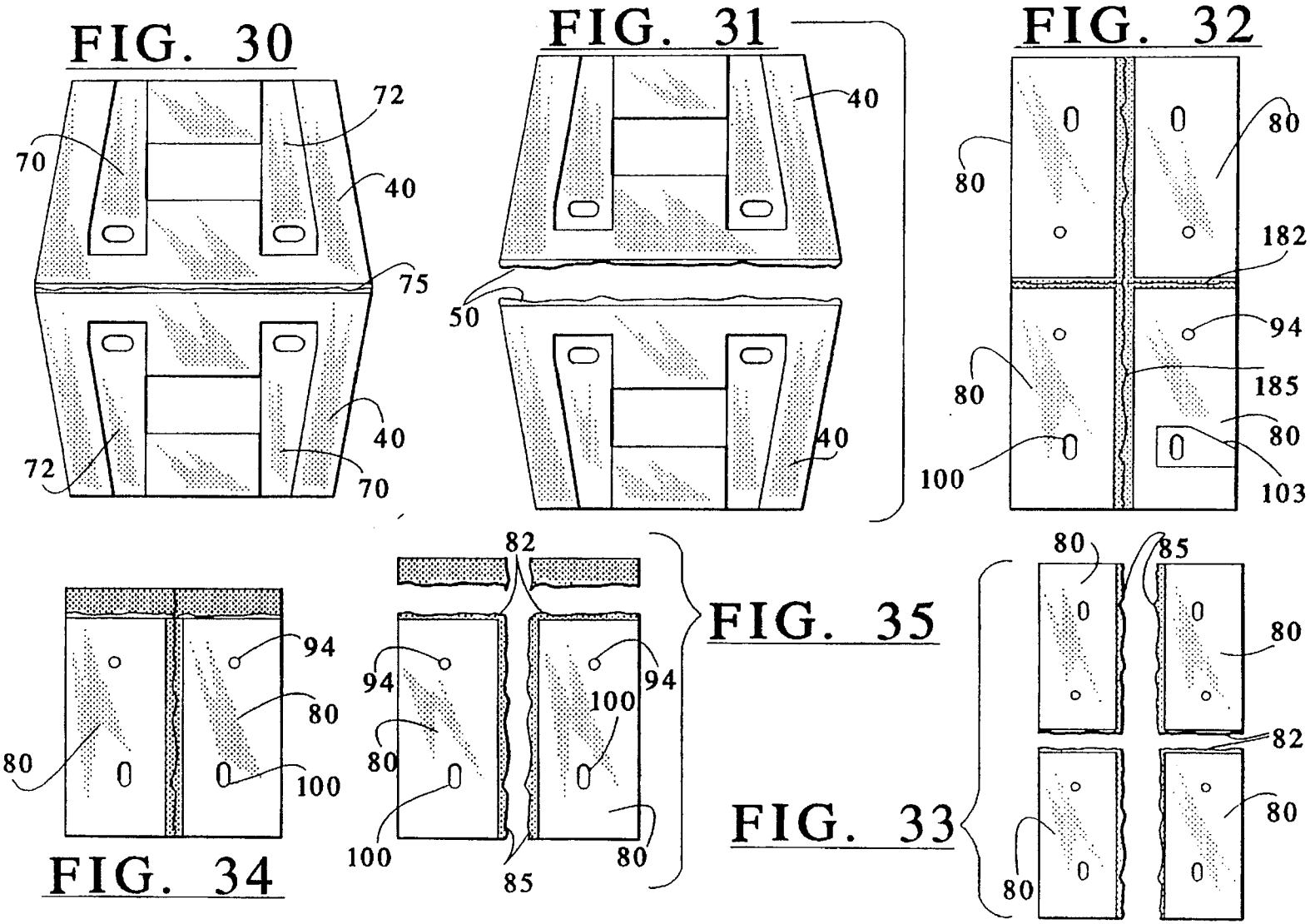
FIG. 30 is a bottom plan view of the modular facing block of the invention as it is initially dry cast in a mold for a pair of facing blocks.
FIG. 31 is a bottom plan view similar to FIG. 30 depicting the manner in which the cast blocks of FIG. 30 are separated to provide a pair of separate modular facing blocks.
FIG. 32 is a top plan view of the cast formation of the corner blocks.
FIG. 33 is a top plan view of the corner blocks of FIG. 32 after they have been split or separated.
FIG. 34 is a plan view of an alternative casting array for corner blocks.
FIG. 35 is a plan view of corner blocks of FIG. 24 separated.

FIG. 2, as well as FIGS. 5 through 13, 13A, 30 through 36A, 44 and 45 illustrate in greater detail the construction of standard modular or facing blocks 40 and various other blocks. FIG. 2, as well as FIGS. 5 through 7, depict the basic modular block 40 which is associated with the invention. FIGS. 30 and 31 are also associated with the basic or standard modular block 40 in FIG. 2. The remaining figures relate to other block constructions.

Standard Modular Block

As depicted in FIGS. 2 and 5 through 7, the standard modular block 40 includes a generally planar front face 50.

The front face 50, in its preferred embodiment, is typically aesthetically textured as a result of the manufacturing process. Texturing is, however, not a limiting characteristic of the front face 50. The front face 50 may include a precast pattern. It may be convex or concave or some other desired cast or molded shape. Because the block 40 is manufactured principally by casting techniques, the variety of shapes and configurations, surface textures and the like for the front face 50 is not generally a limiting feature of the invention.

The front face 50, however, does define the outline of the modular blocks comprising the wall as shown in FIG. 1. Thus, the front face 50 defines a generally rectangular front elevation configuration, and because the blocks 40 are typically manufactured by means of casting techniques, the dimensions of the perimeter of front face 50 are typically those associated with a standard concrete block construction. The size or dimension, however, is not a limiting feature of the invention.

Spaced from and generally parallel to the front face 50 is a back face 52. The back face 52 is connected to the front face 50 by means of side walls 54 and 56 which generally converge towards one another from the front face 50. The convergence is generally uniform and equal on both sides of the block 40. Convergence may commence from front edges 51, 53, or may commence a distance from front face 50 toward back face 52. Convergence may be defined by a single flat side surface or multiple flat or curved side surfaces. The convergence angle is generally in the range of 7° to 15°, in the preferred embodiment of the invention, though, a range of convergence of 0° to about 30° is useful.

The thickness of the block 40, or in other words the distance between the front face 50 and back face 52, may be varied in accord with engineering and structural considerations. Again, typical dimensions associated with concrete block constructions are often relied upon by casters and those involved in precast or dry cast operations of block 40. Thus, for example, if the dimensions of the front face 50 are 16 inches wide by 8 inches high, the width of the back face would be approximately 12 inches and the depth or distance between the faces 50, 52 would be approximately 8, 10 or 12 inches.

In the embodiment shown, the side walls 54 and 56 are also rectangular as is the back face 52. Parallel top and bottom surfaces 58 and 60 each have a trapezoidal configuration and intersect the faces 50, 52 and walls 54, 56. In the preferred embodiment, the surfaces 58, 60 are congruent and parallel to each other and are also at generally right angles with respect to the front face 50 and back face 52.

The block 40 includes a first vertical passage or throughbore 62 and a second vertical passage or throughbore 64. Throughbores 62, 64 are generally parallel to one another and extend between surfaces 58, 60. As depicted in FIG. 5 the cross-sectional configurations of the throughbores 62 and 64 are preferably uniform along their length. The throughbores 62, 64 each include a centerline axis 66 and 68, respectively. The cross-sectional shape of each of the throughbores 62 and 64 is substantially identical and comprises an elongated or elliptical configuration or shape.

Each of the throughbores 62 and 64 and, more particularly, the axis 66 and 68 thereof, is precisely positioned relative to the side edges 51 and 53 of the front face 50. The side edges 51 and 53 are defined by the intersection respectively of the side wall 54 and front face 50 and side wall 56 and front face 50. The axis 66 is one-quarter of the distance between the side edge 53 and the side edge 51. The axis 68 is one-quarter of the distance between the side edge 51 and the side edge 53. Thus the axes 66 and 68 are arrayed or spaced one from the other by a distance equal to the sum of the distances that the axes 66, 68 are spaced from the side edges 51 and 53.

The throughbores 62 and 64 are positioned intermediate the front face 50 and back face 52 approximately one-quarter of the distance from the front face 50 toward the back face 52, although this distance may be varied depending upon engineering and other structural considerations associated with the block 40. As explained below, compressive forces on the block 40 result when an anchoring rod 46, which fits within each one of the throughbores 62 and 64, engages against a surface of each throughbore 62 or 64 most nearly adjacent the back face 52. The force is generally a compressive force on the material comprising the block 40. Thus, it is necessary, from a structural analysis viewpoint, to ensure that the throughbores 62 and 64 are appropriately positioned to accommodate the compressive forces on block 40 in a manner which will maintain the integrity of the block 40.

A counterbore 70 is provided with the throughbore 62. Similarly, a counterbore 72 is provided with the throughbore 64. Referring first to the counterbore 70, the counterbore 70 is defined in the surface 58 and extends from back face 52 over and around the throughbore 62. Importantly, the counterbore 70 defines a pathway between the throughbore 62 and the back face 52 wherein a tensile member (described below) may be placed in a manner such that the tensile member may remain generally perpendicular to an element, such as rod 46, positioned in the throughbore 62.

In a similar fashion, the counterbore 72 extends from the back face 52 in the surface 58 and around the throughbore 64. In the preferred embodiment, the counterbores 70 and 72 are provided in the top face 58 uniformly for all of the blocks 40. However, it is possible to provide the counterbores in the bottom face 60 or in both faces 58 and 60. Note that since the blocks 40 may be inverted, the faces 58 and 60 may be inverted between a top and bottom position. In sum, the counterbores 70 and 72 are aligned with and constitute counterbores for the throughbores 62 and 64, respectively.

In the preferred embodiment, a rectangular cross-section passage 74 extends parallel to the throughbores 62 and 64 through the block 40 from the top surface 58 to the bottom surface 60. The passage 74 is provided to eliminate weight and bulk of the block 40 without reducing the structural integrity of the block. It also provides a transverse counterbore connecting counterbores 70 and 72. The passage 74 is not necessarily required in the block 40. The particular configuration and orientation, shape and extent of the passage 74 may be varied considerably in order to eliminate bulk and material from the block 40.

The general cross-section of the throughbores 62 and 64 may be varied. Importantly, it is appropriate and preferred that the cross-sectional shape of the throughbores 62 and 64 permits lateral movement of the block 40 relative to anchoring rods 46, for example, which are inserted in the throughbores 62 and 64. Thus, the dimension of the throughbores 62 and 64 in the direction parallel to the back face 52 in the embodiment shown is chosen so as to be greater than the diameter of a rod 46. The transverse (or front to back) dimension of the throughbores 62 and 64 more closely approximates the diameter of the rod 46 so that the blocks 40 will not be movable from front to back into and out of a position. That is, the front face 50 of each of the blocks 40 in separate courses and on top of each other can be maintained in alignment because of the size and configuration of throughbores 62, 64. Consequently, the blocks 40 can be preferably adjusted from side to side as one builds a wall of the type depicted in FIG. 1, though the blocks 40 are not adjustable inwardly or outwardly to any great extent. This maintains the planar integrity of the assembly comprising the retaining wall so that the blocks 40 will be maintained in a desired and generally planar array. Side to side adjustment insures that any gap between the blocks 40 is maintained at a minimum and also permits, as will be explained below, various adjustments such as required for formation of inside and outside curvature of the wall construction.

The depth of the counterbores 70 and 72 is variable. It is preferred that the depth be at least adequate to permit the elements 42 and/or 44 to be maintained below or no higher than the level of surface 58, so that when an additional course of blocks 40 is laid upon a lower course of blocks 40, the elements 42 and/or 44 are appropriately and properly recessed so as not to interfere with an upper course of blocks 40.

Referring briefly to FIGS. 30 and 31, there is illustrated a manner in which the standard modular blocks of FIGS. 2 and 5 can be manufactured. Typically, such blocks may be cast in pairs using dry casting techniques with the front face of the blocks 40 cast in opposition to each other with a split line such as split line 75 as depicted in FIG. 30. Then after the blocks 40 are cast, a wedge or shear may be utilized to split or separate blocks 40 one from the other revealing a textured face such as illustrated in FIG. 31. Appropriate drag and draft angles are incorporated in the molds with respect to such a casting operation as will be understood by those of ordinary skill in the art. Also note, the dry cast blocks 40 are not typically reinforced. However, the dry cast blocks may include reinforcing fibers. Lack of reinforcement and manufacture by dry casting techniques of a block 40 for use with metallic and/or generally rigid stabilizing elements is not known to be depicted or used in the prior art.

Corner and/or Split Face Blocks

FIGS. 8 through 13A, and 32 through 36A depict blocks that are used to form corners and/or caps of the improved retaining wall construction of the invention or to define a boundary or split face in such a retaining wall. FIGS. 8, 9 and 10 disclose a first corner block 80 which is similar to, but dimensionally different from the corner blocks of FIGS. 11, 12 and 13 and the corner block 110 of FIG. 13A.

Referring, therefore, to FIGS. 8, 9 and 10, corner block 80 comprises a front face 82, a back face 84, a finished side surface 86 and a unfinished side surface 88. A top surface 90 is parallel to a bottom surface 92. The surfaces and faces generally define a rectangular parallelpiped. The front face 82 and the finished side surface 86 are generally planar and may be finished with a texture, color, composition and configuration which is compatible with or identical to the surface treatment of blocks 40. The corner block 80 includes a first throughbore 94 which extends from the top surface 90 through the bottom surface 92. The throughbore 94 is generally cylindrical in shape; however, the throughbore 94 may include a funnel shaped or frusto-conical section 96 which facilitates cooperation with a rod, such as rod 46, as will be explained below.

The cross-sectional area of the throughbore 94 is slightly larger than the cross-sectional area and configuration of a compatible rod, such as rod 46, which is designed to fit through the throughbore 94. Importantly, the cross-sectional shape of the throughbore 94 and the associated rod, such as rod 46, are generally congruent to preclude any significant alteration and orientation of a positioned corner block 80 once a rod 46 is inserted through a throughbore 94.

The position of the first throughbore 94 relative to the surfaces 82, 84 and 86 is an important factor in the design of the corner block 80. That is, the throughbore 94 includes a centerline axis 98. The axis 98 is substantially an equal distance from each of the surfaces 82, 84 and 86, thus rendering the distances x, y and z in FIG. 8 substantially equal, where x is the distance between the axis 98 and the surface 82, y is the distance between the axis 98 and the surface 84, and z is the distance between the axis 98 and the surface 86.

The corner block 80 further includes a second throughbore 100 which extends from the top surface 90 through the bottom surface 92. The second throughbore 100 may also include a funnel shaped or frusto-conical section 104. The cross-sectional shape of the throughbore 100 generally has an elongated or elliptical form and has a generally central axis 102 which is parallel to the surfaces 82, 84, 86 and 88. The longitudinal dimension of the cross-sectional configuration of the second throughbore 100 is generally parallel to the front face 82. The axis 102 is specially positioned relative to the side surface 88 and the front face 82. Thus the axis 102 is positioned a distance w from the front face 82 which is substantially equal to the distance w which axis 66 is positioned from front face 50 of the block 40 as depicted in FIG. 5. The axis 102 is also positioned a distance v from the unfinished side surface 88 which is substantially equal to the distance c which the axis 62 is positioned from the edge 53 of the front face 50 of the block 40 as depicted again in FIG. 5. A counterbore 103 may be provided for throughbore 100. Counterbore 103 extends from back surface 84 and around bore 100. The counterbore 103 may be provided in both top and bottom surfaces 90 and 92.

The distance u between the axis 102 and the axis 98 for the corner block 80 is depicted in FIG. 8 and is equal to the distance u between the axis 66 and the axis 68 for the block 40 in FIG. 5. The distance u is substantially two times the distance v. The distance v between the axis 102 and the side surface 88 is substantially equal to the distance z between the axis 98 and the side surface 86. The correlation of the various ratios of the distances for the various blocks 40, 80 and 110 set forth above is summarized in the following Table No. 1:

TABLE 1

| | |
|---|---|
| For Block 40 | $2v = u$ |
| For Corner Block 80 | $x = y = z$ |
| | $x + y = u$ |
| | $v + z = u$ |
| For Corner Block 110 | $a = b = c$ |
| | $d = v + c$ |

Figure 13:
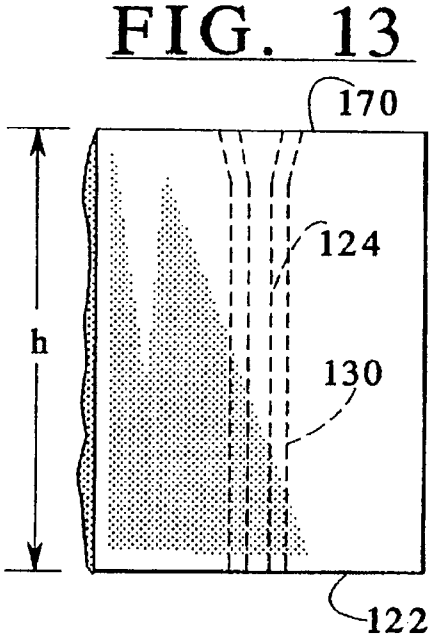
FIG. 13 is a side elevation of the block of FIG. 11.
Figure 11:
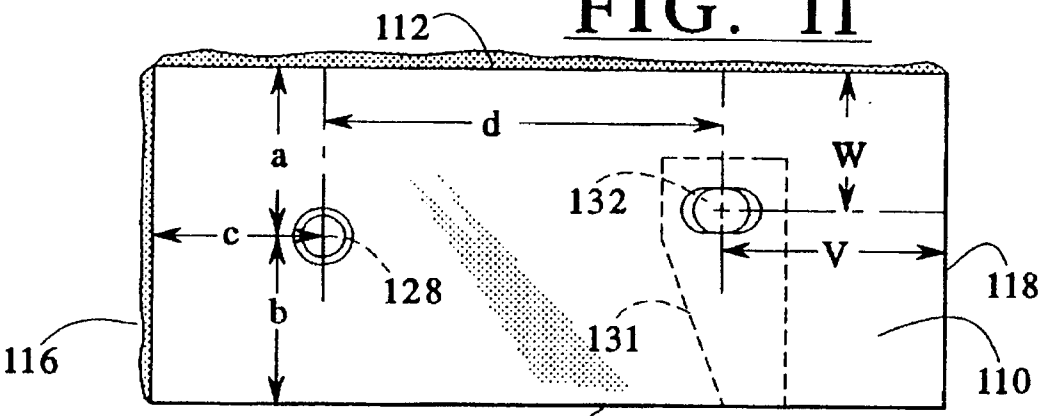
FIG. 11 is a top plan view of an alternative corner block construction.
Figure 12:
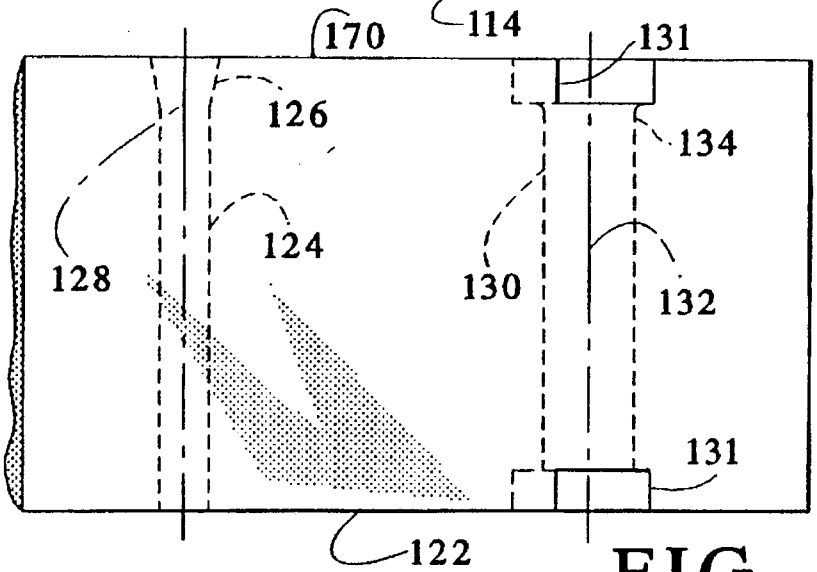
FIG. 12 is a rear elevation of the block of FIG. 11.

It is to be noted that the corner block 80 of FIGS. 8, 9 and 10 is a corner block 80 wherein the perimeter of the front face 82 is dimensionally substantially equal to the front face 50 of the block 40. FIGS. 11, 12 and 13 illustrate an alternative corner block construction wherein the front face and finished side face or surface are different dimensionally from that of the corner block 80 in FIGS. 8, 9 and 10.

Referring therefore to FIGS. 11, 12 and 13, a corner block 110 includes a front face 112, a back face 114, a finished side surface 116, an unfinished side surface 118, top and bottom parallel surfaces 120 and 122. The block 110 has a rectangular, parallelpiped configuration like the block 80. The block 110 includes a first throughbore 124, having a shape and configuration substantially identical to that of the first throughbore 94 previously described including the frusto-conical section 126, and an axis 128. Similarly, the block 110 includes a second throughbore 130 having an axis 132 with a cross-sectional configuration substantially identical to that of the second throughbore 100 and also including a frusto-conical or funnel shaped section 134. Also, counterbores 131 may be provided in the top and bottom surfaces 120, 122. The front face 112 and finished side surface 116 are finished, as previously described with respect to front face 50, in any desired fashion. The front face 112 has a height dimension as illustrated in FIG. 13 as height h which is substantially equal to the height h of the block 40 in FIG. 7, as well as the height h of the block 80 as illustrated in FIG. 10.

The axis 128 is again equally spaced from the face 112, surface 116 and surface 114 as illustrated in FIG. 11. Thus, the distance a from the surface 112 to axis 128 equals the distance b from the face 114 to the axis 128 which also equals the distance c from the surface 116 to the axis 128. The axis 132 is spaced from the front face 112 by the distance w which again is equal to the distance w of spacing of axis 66 from face 50 of block 40 as shown in FIG. 5. Similarly, the axis 132 is spaced a distance v from the unfinished side surface 118 which is equal to the distance c associated with the block 40 as depicted in FIG. 5. The distance between the axis 132 and the axis 128 represented by d in FIG. 11 equals the distance v between axis 132 and surface 118 plus distance c, the distance between axis 128 and finished side surface 116. Again, these dimensional relationships are set forth in Table 1.

FIG. 13A illustrates the configuration of a corner block which is reversible and includes throughbores 99, 101 which are shaped with an L shaped cross section so as to function as though they are a combination of throughbores 124, 130 of the embodiment of FIG. 11. Thus, bores 99 and 101 each include an axis 128*a* which is equivalent to axis 128 of the corner block of FIG. 11 and a second axis 132*a* which is equivalent to the axis 132 of the block of FIG. 11.

Other alternative block constructions are possible within the scope of the invention and some modifications and alternatives are discussed below. However, the afore-described block 40 as well as the corner blocks 80 and 110 are principal modular blocks to practice the preferred embodiment of the invention.

Stabilizing Elements

Figure 14:
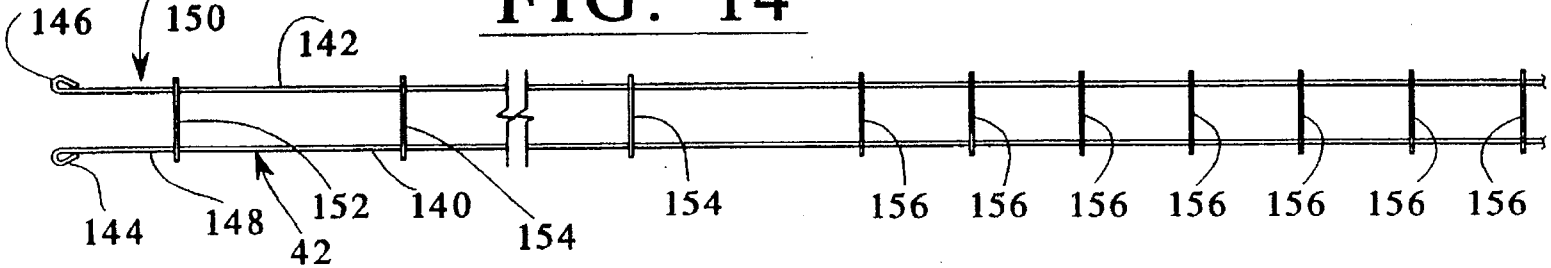
FIG. 14 is a top plan view of a typical earth stabilizing element or component of the type depicted in FIG. 3.

The second major component of the retaining wall construction comprises retaining elements which are interactive with and cooperate with the blocks 40, 80, and 110, particularly the basic block 40. FIGS. 14 through 17 illustrate various stabilizing elements. Referring first to FIG. 14, there is illustrated a stabilizing element 42 which is comprised of a first parallel reinforcing bar 140 and a second parallel reinforcing bar 142. The bars 140 and 142 each have a loop 144 and 146 respectively formed at an inner end thereof. Typically, the bars 140 and 142 are deformed to form the loops 144, 146 and the ends of the loops 144, 146 are welded back onto the bar 140 and 142.

Importantly, each loop 144 and 146 is connected to a tension arm 148 and 150 defined by the bars 140 and 142. The tension arms 148 and 150 arc parallel to one another and are of such a length so as to extend beyond the back face of any of the blocks previously described. A cross member 152, positioned beyond the back face of the block 40, connects the arms 148 and 150 to ensure their appropriate spacing and alignment. A second cross member 154 ensures that the arms 148 and 150, as well as the bars 140 and 142, remain generally parallel.

There are additional cross members 156 provided along the length of the bars 140 and 142. The spacing of the cross members 156 is preferably generally uniform along the outer ends of the bars 140 and 142. The uniformly spaced cross members 156 are associated with the passive or resistive zone of a mechanically stabilized earth structure as will be described in further detail below. The cross members 156 are thus preferably uniformly spaced one from the other at generally closer intervals in the so called passive or resistive zone. However, this is not a limiting feature and uniform spacing may be preferred by a wall engineer. The bars or cross members 154, as well as cross member 152, are not necessarily closely spaced or even required so long as the bars 140 and 142 are maintained in a substantially parallel array.

It is noted that in the preferred embodiment, that just two bars 140 and 142 are required or are provided. However, stabilizing elements having one or more longitudinal members (e.g. bars 140, 142) may be utilized. The stabilizing element depicted and described with respect to FIG. 14 relies upon frictional interaction but could be configured to rely, as well, upon anchoring interaction with compacted soil. The cross members 156, thus, could be configured to act as a collection of anchors. The bars 140 and 142 and cross members 156 in the preferred embodiment provide frictional interaction with compacted soil.

Figure 15:
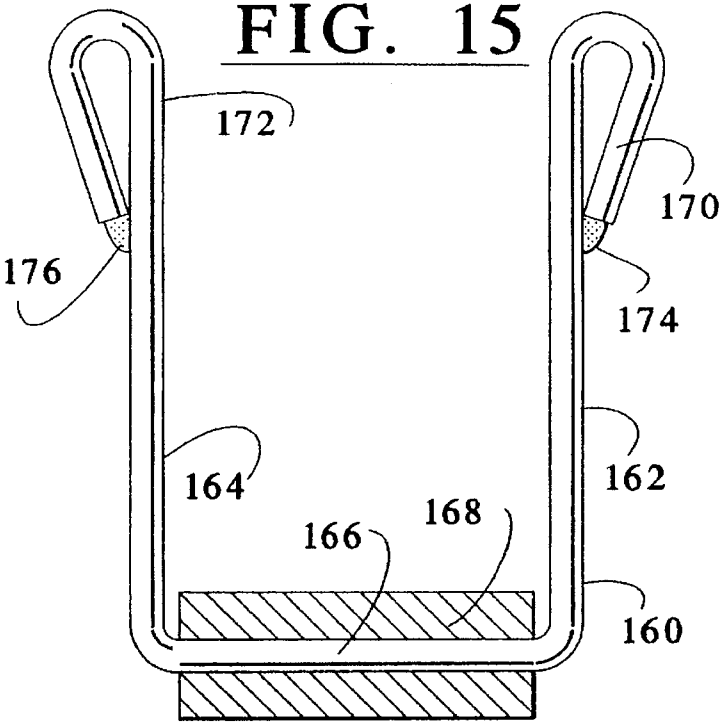
FIG. 15 is a top plan view of a component of an alternative earth stabilizing element.
Figure 15A:
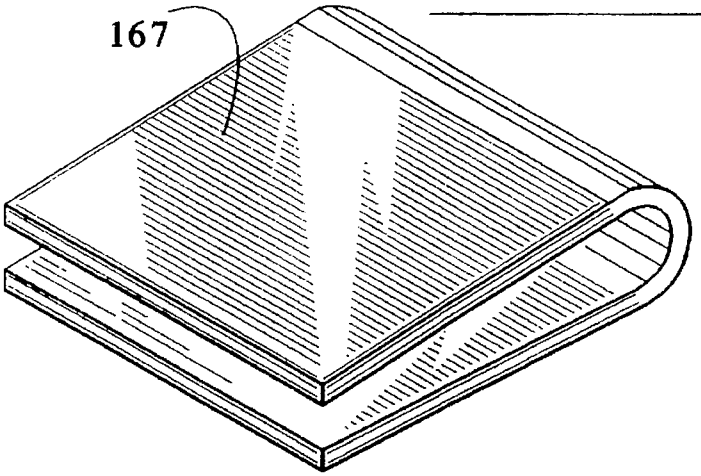
FIG. 15A is an isometric view of an alternative component for the element of FIG. 15.

FIG. 15 illustrates a component of a further alternative stabilizing element 44. Specifically referring to FIG. 15, the element depicted includes a harness or connector 160 which includes a first tension bar or arm 162 and a second bar or arm 164. Arms 162 and 164 are generally parallel to one another and are connected by a cross member 166, which in this case also includes a cylindrical, tubular member 168 retained thereon. Alternatively, as depicted in FIG. 15A, a C-shaped clamp member 167 may be fitted over the cross member 166.

Each of the parallel tension arms 162 and 164 terminate with a loop 170 and 172. The loops 170 and 172 are arranged in opposed relationship and aligned with one another as depicted in FIG. 15. The ends of the loops 170 and 172 are welded at welds 174 and 176, respectively to the arms 162 and 164, respectively.

Figure 17:
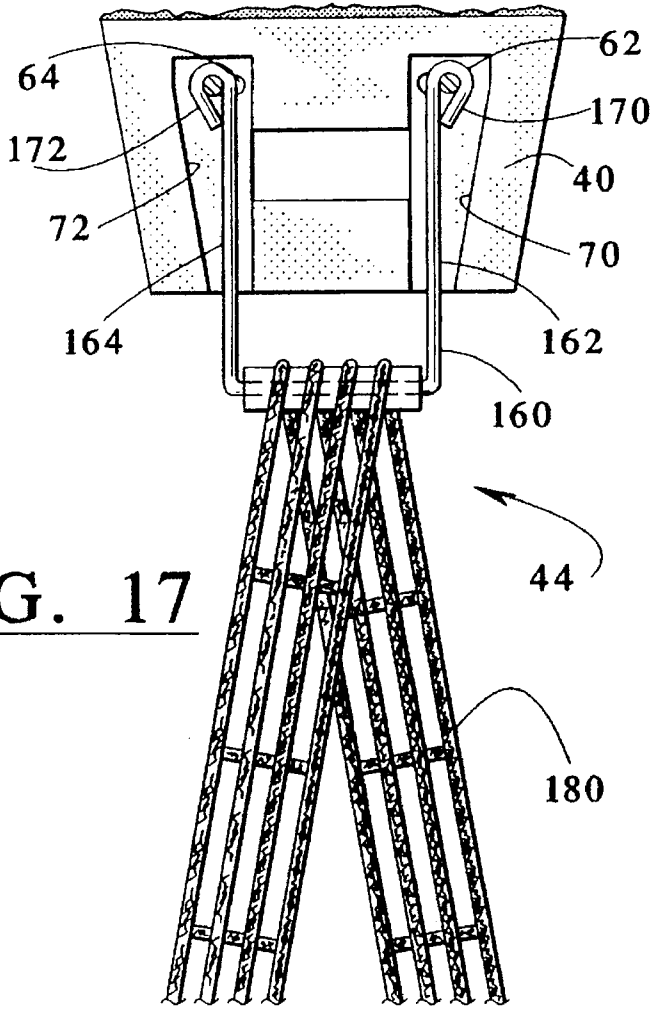
FIG. 17 is a bottom plan view of the component or element depicted in FIG. 16 in combination with a flexible geotextile material and a block of the type shown in FIG. 2.
Figure 16:
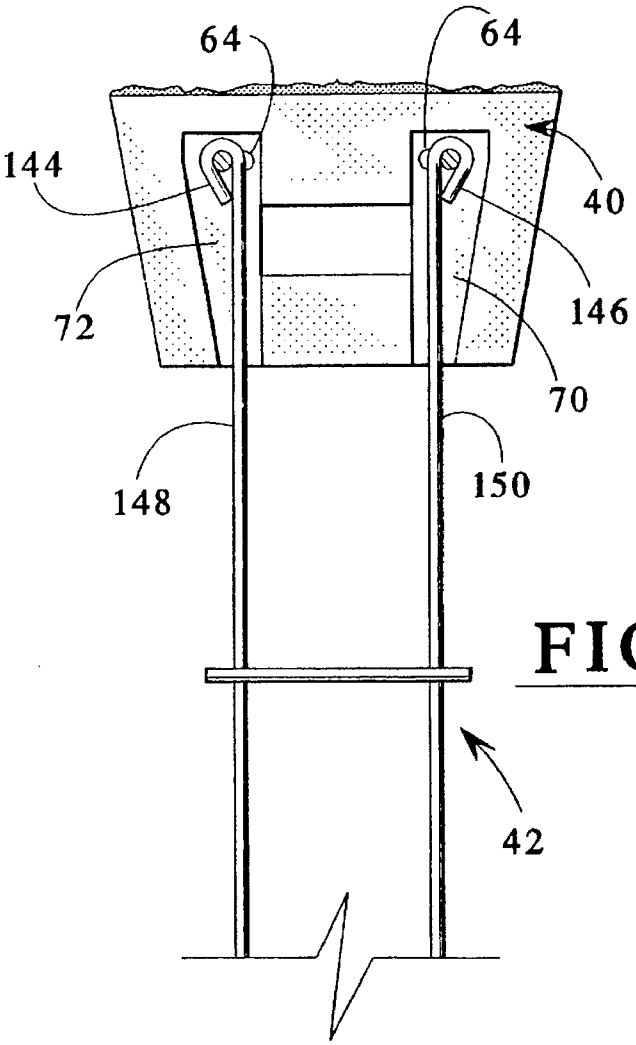
FIG. 16 is a bottom plan view of the element shown in FIG. 14 in combination with a block of the type shown in FIG. 2.

The harness or connector 160 is cooperative with the blocks, most particularly block 40, as will be described in further detail. That detail is illustrated, in part, in FIGS. 16 and 17. Referring first to FIG. 16, there is depicted a stabilizing element 42. FIG. 17 illustrates the stabilizing element 44. Referring to FIG. 16 the element 42 and more particularly the tension arms 148 and 150 are positioned in the counterbores 70 and 72 of block 40 with the loops 144 and 146 positioned over the throughbores 64 and 62, respectively.

Referring to FIG. 17, the connector 160, which comprises a portion of the stabilizing element 44, includes arms 162 and 164 which are fitted into the counterbores 70 and 72, respectively of block 40 with loops 170 and 172, respectively fitted over the throughbores 62 and 64. Note that connector 160 is sufficiently recessed within the block 40 so as to be below the plane of the top surface 58 thereof. Similarly, the tension arms 148 and 150 of the element 42 are sufficiently recessed within the counterbores 70 and 72 to be below the plane or no higher than the plane of the top surface 58 of the block 40.

Referring again to FIG. 17, the element 44 further includes a geotextile material comprising a lattice of polymeric strips, such as strip 180, which is generally flexible and wherein an elongated length thereof is wrapped around or fitted over the tube or cylinder 168 or clamp 167 so that the opposite ends of the strips 180 extend outwardly and away from the block 40. Thus, FIG. 16 illustrates a generally rigid element. FIG. 17 illustrates a generally flexible element. In each event, the elements 42 and 44 are cooperative with a block 40 as described.

Connectors

Figure 4A:
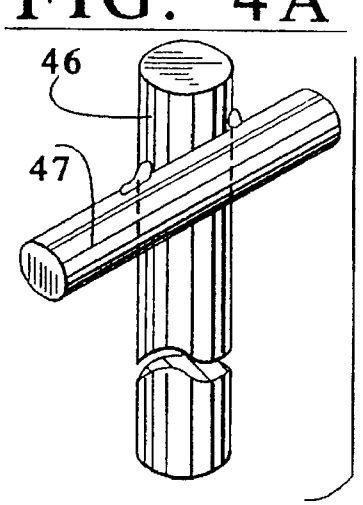
FIG. 4A is an alternate construction of the rod of FIG. 4.
Figure 4:
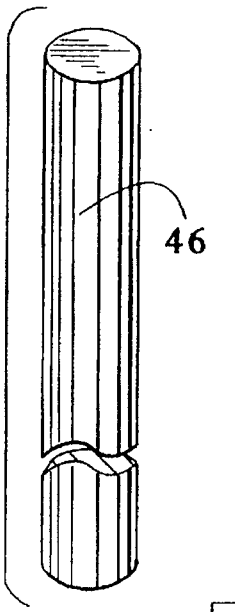
FIG. 4 is an isometric view of a typical anchoring rod which interacts with the wall block of FIG. 2 and the earth stabilizing element of FIG. 3 in the construction of the improved retaining wall of the invention.

Depicted in FIG. 4 is a typical connector which comprises a reinforcing rod or bar, normally a steel reinforcing bar 46, which is generally cylindrical in shape and which is fitted through loops, for example loops 170 and 172 in FIG. 17 and associated throughbores 62 and 64 of block 40 to thereby serve to retain the element 44 and more particularly the connector 160 cooperatively engaged with block 40. The rod 46, which is depicted as the preferred embodiment, is cylindrical as previously mentioned. However, any desired size may be utilized. It is to be noted that the steel reinforcing bars, which are recommended in order to practice the invention, are also utilized in cooperation with the specially configured first throughbores 94, 124 of the corner blocks 80, 110. For example first throughbore 124 of the corner block 110 illustrated in FIG. 12 cooperates with a rod such as rod 46 illustrated in FIG. 4. The rods 46 are of a sufficient length so that they will project through at least two adjacent blocks 40 which are stacked one on top of the other thus distributing the compressive forces resulting from the elements 44 interacting with the blocks 40 to blocks of adjacent courses forming a wall.

As depicted in FIG. 4A, the rod 46 may include a small stop or cross bar 47 welded or attached at its midpoint. Cross bar 47 insures that the rod 46 will be positioned properly and retained in position to engage blocks 40 above and below the block 40 in which rod 46 is positioned to cooperate with elements 42, 44. Thus, the rod 46 will not fall or slip downward into throughbores 62, 64.

Retaining Wall System

Figure 18:
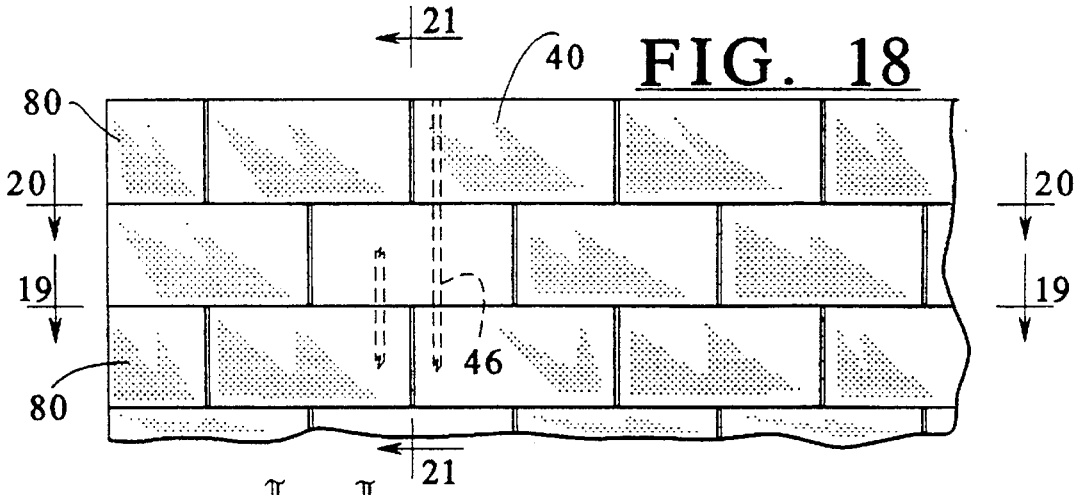
FIG. 18 is a front elevation of a typical assembly of the modular wall blocks of FIG. 2 and corner blocks such as shown in FIG. 8 in combination with the other components and elements forming a retaining wall.

FIGS. 18 through 29 illustrate the manner of assembly of the components heretofore described to provide a retaining wall. Referring first to FIG. 18, there is depicted an array of three courses of modular blocks 40 and corner blocks 80 to define a section or portion of a wall using the components of the invention. Note that each of the courses provide that the blocks 40 are overlapping. Note further that the front face dimensions of the corner block 80 are equal to the front face dimensions of the modular blocks 40. The side face or surface dimensions of the corner blocks 80 are equal to one half of the dimensions of the basic blocks 40.

Figure 19:
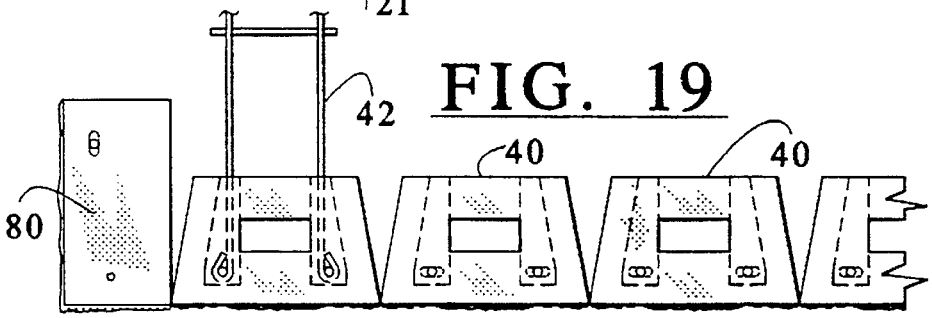
FIG. 19 is a sectional view of the wall of FIG. 18 taken substantially along the line 19—19.

FIG. 19, which is a sectional view of the wall of FIG. 18, illustrates the manner of positioning the corner blocks 80 and modular basic building blocks 40 with respect to each other to define the first course of the wall depicted in FIG. 18. Note that elements 42, which are the rigid stabilizing elements, are cooperatively positioned for interaction with the blocks 40. In the preferred embodiment, stabilizing elements 42 are provided for use in association with each and every one of the modular blocks 40 and the elements 42 include only two parallel reinforcing bars. It is possible to provide for constructions which would have a multiple number of reinforcing bars or special anchoring elements attached to the bars. The preferred embodiment is to use just two bars in order to conserve with respect to cost, and further, the two bar construction provides for efficient distribution of tensile forces and anchoring forces on the element 42, and torsional forces are significantly reduced.

Figure 20:
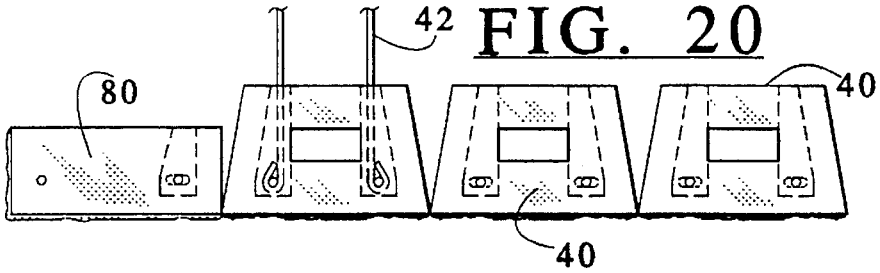
FIG. 20 is a sectional view of the wall of FIG. 18 taken along line 20—20 in FIG. 18.

FIG. 20 illustrates the manner in which the comer block 80 may be positioned in order to define an edge or corner of the wall depicted in FIG. 18. Thus, the block 80, which is a very symmetrical block as previously described, may be alternated between positions shown in FIGS. 19 and 20. Moreover, the corner blocks 80 may be further oriented as depicted and described with respect to FIGS. 27 through 29 below. The element 44, which is a stabilizing element utilizing a flexible polymeric or geotextile material, is depicted as being used with respect to the course or layer of blocks 40 defining or depicted in FIG. 20.

Figure 21:
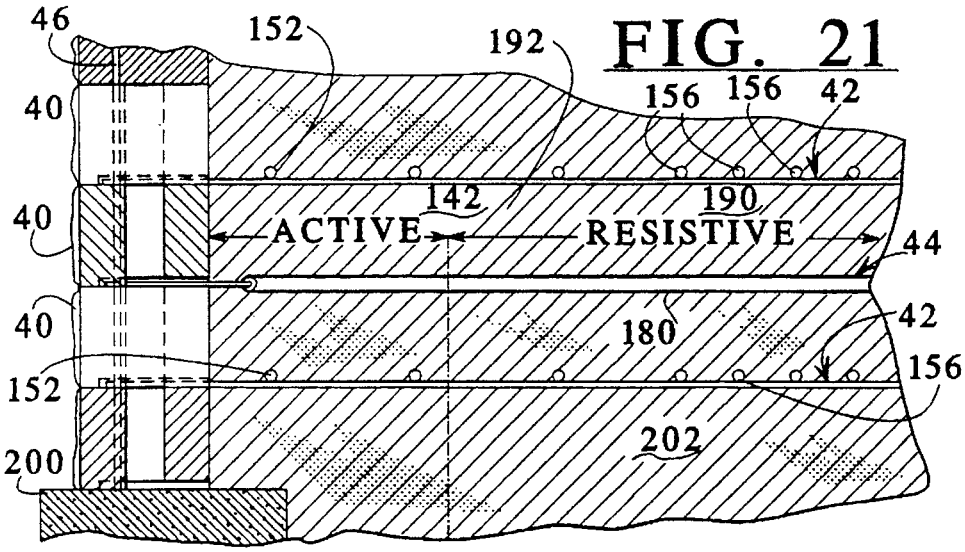
FIG. 21 is a cross sectional view of the wall of FIG. 18 taken substantially along the line 21—21.

FIG. 21 is a side sectional view of the wall construction of FIG. 18. It is to be noted that the wall is designed so that the cross elements 156 are retained in the so-called resistive zone associated with such mechanically stabilized earth structures. As known to those of ordinary skill in the art, construction of such walls and the analysis thereof calls for the defining of a resistive zone 190 and an active zone 192. The elements 42 are designed so that the cross members 156 are preferably more numerous in the resistive zone thus improving the efficiency of the anchoring features associated with the elements 42. However, this is not a limiting feature. FIG. 21 illustrates also the use of the polymeric grid material 180. It is to be noted that all of the elements 42 and/or 44 are retained in a compacted soil or compacted earth in a manner described in the previously referenced prior art patents. Reference is made to the American Association of State Highway and Transportation Officials "Standard Specification for Highway Bridges", Fourteenth Edition as amended (1990, 1991) and incorporated herewith by reference, for an explanation of design calculation procedures applicable for such constructions.

In FIG. 21, there is illustrated the placement of a stabilizing element, such as elements 42 or 44, in association with each and every course of blocks 40, 80. In actual practice, however, the stabilizing elements 42 and/or 44 may be utilized in association with separate layers or courses, eg. every second, third or fourth course of blocks 40, 80 and/or at separate blocks, eg. every second or third block horizontally in accord with good design principles. This does not, however, preclude utilization of the stabilizing elements 42, 44 in association with each and every course and each and every block 40, 80. Thus, it has been found that the mechanically stabilized earth reinforcement does not necessarily require stabilizing elements at every possible block position. Again, calculations with respect to this can be provided using techniques known to those of ordinary skill in the art such as referenced herein.

During construction, a course of blocks 40 are initially positioned in a line on a desired footing 200, which may consist of granular fill, earthen fill, concrete or other leveling material. Earthen backfill material 202 is then placed behind the blocks 40. An element, such as stabilizing element 42, may then be positioned in the special counterbores 70, 72 in a manner previously described and defined in the blocks 40, 80. Rods 46 may then be inserted to maintain the elements 42 in position with respect to the blocks 40. The rods 46 should, as previously described, interact with at least two adjacent courses of blocks 40. A layer of sealant, fabric or other material (not shown) may be placed on the blocks. Subsequently, a further layer of blocks 40 is positioned onto the rods 46. Additional soil or backfill 202 is placed behind the blocks 40, and the process continues as the wall is erected.

In practice, it has been found preferable to orient the counterbores 70, 72 facing downward rather than upward during construction. This orientation facilitates keeping the counterbores 70, 72 free of debris, etc. during construction.

Figure 23:
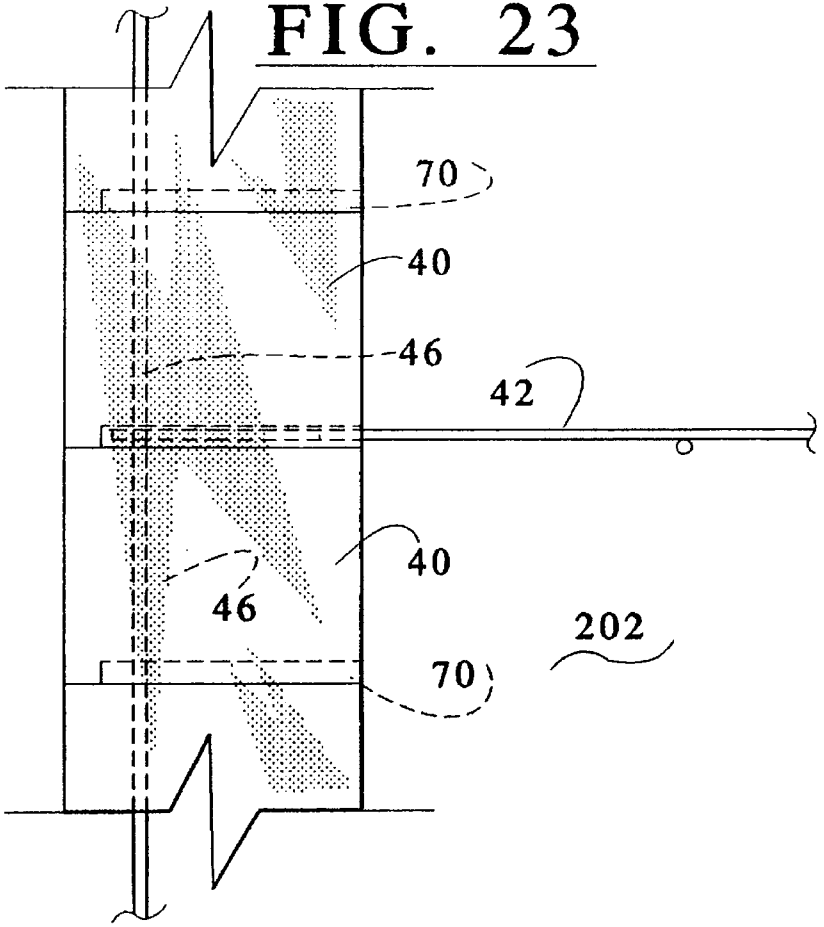
FIG. 23 is a side sectional view of a combination of elements of the type depicted in FIG. 16.
Figure 22:
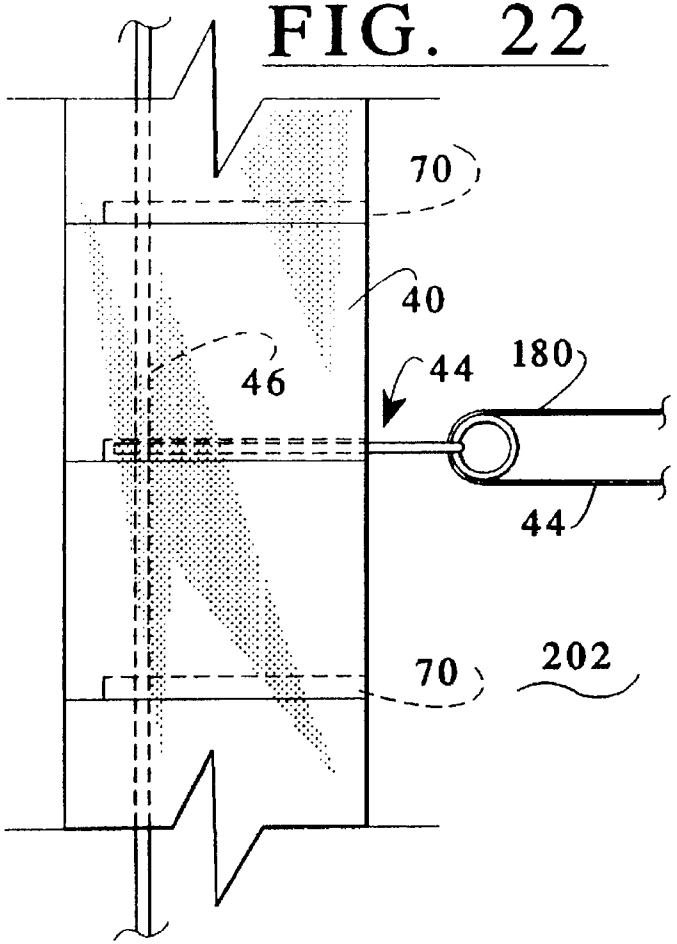
FIG. 22 is a side sectional view of a combination of the type depicted in FIG. 17.

FIGS. 22 and 23 illustrate side elevations of the construction utilizing a flexible stabilizing element 44 in FIG. 22 and a rigid stabilizing element 42 in FIG. 23. In each instance, the elements 42 and/or 44 are cooperative with blocks 40, rods 46 and compacted soil 202 as previously described.

Figure 24:
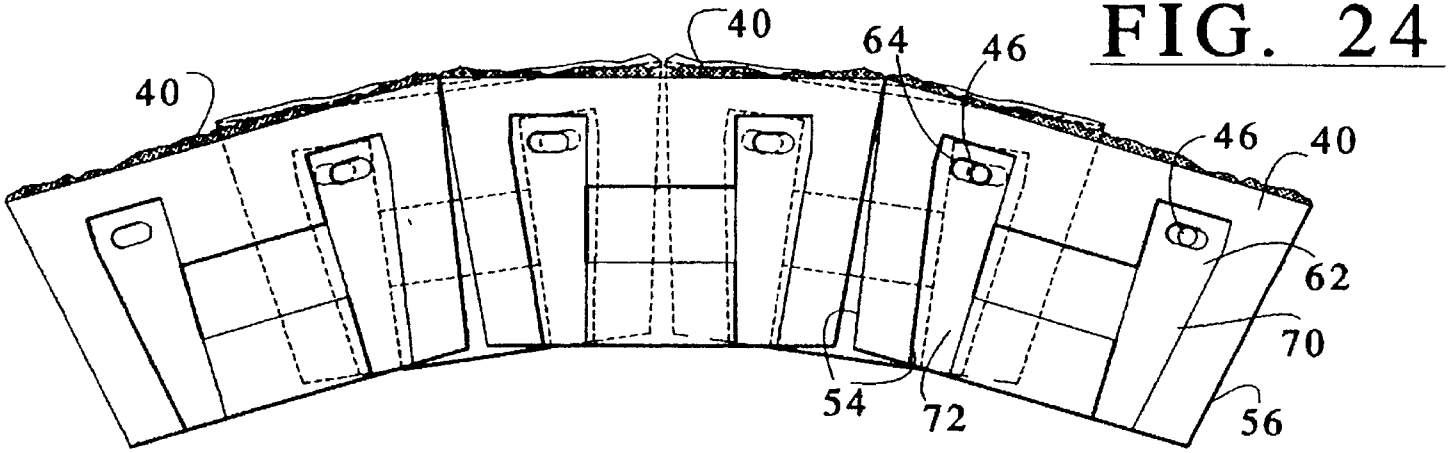
FIG. 24 is a top plan view of a typical retaining wall construction depicting the arrangement of the modular block elements to form an outside curve.
Figure 25:
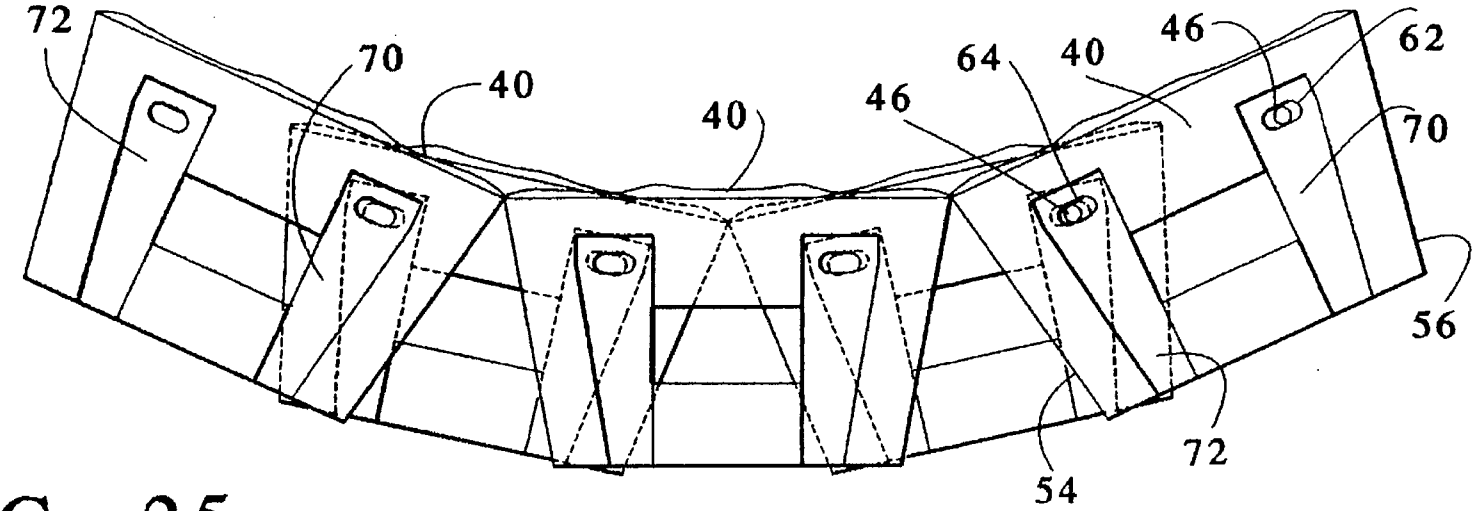
FIG. 25 is a top plan view of modular block elements arranged so as to form an inside curve.

Referring next to FIGS. 24 and 25, as previously noted, the throughbores 62, 64 in the blocks 40 have an elongated cross-sectional configuration. Such elongation permits a slight adjustable movement of the blocks 40 laterally with respect to each other to ensure that any tolerances associated with the manufacture of the blocks 40 are accommodated. It was further noted that the blocks 40 are defined to include converging side surfaces 54, 56. Because the side surfaces 54, 56 are converging, it is possible to form a wall having an outside curve as depicted in FIG. 24 or an inside curve as depicted in FIG. 25. In each instance, the mode of assembly and the cooperative interaction of the stabilizing elements 42, 44 and rods 46 as well as blocks 40 are substantially as previously described with respect to a wall having a flat front surface.

Figure 26:
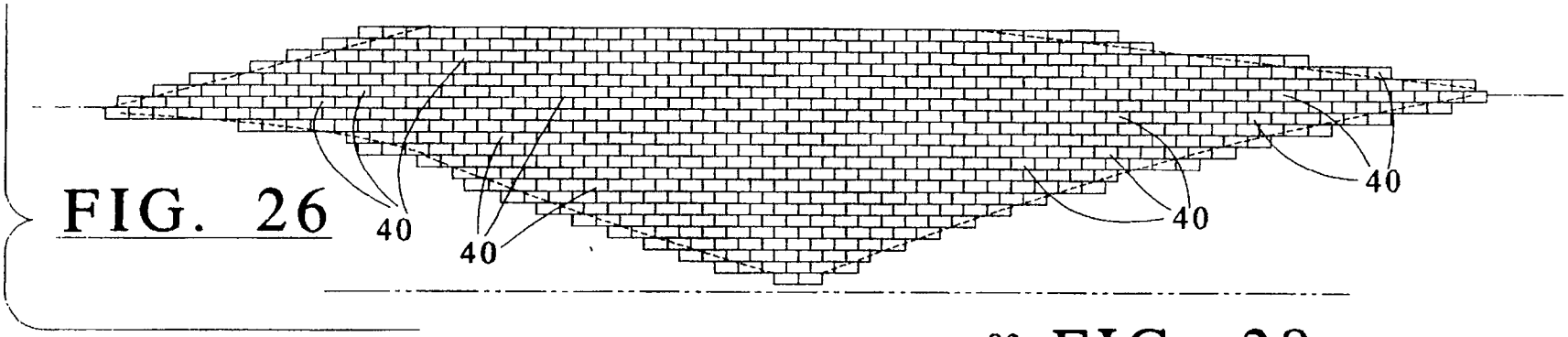
FIG. 26 is a front elevation depicting a typical retaining wall in accord with the invention.

FIG. 26 illustrates the versatility of the construction of the present invention. Walls of various shapes, dimensions and heights may be constructed. It is to be noted that with the combination of the present invention the front face of the wall may be substantially planar and may rise substantially vertically from a footing. Though it is possible to set back the wall or tilt the wall as it ascends, that requirement is not necessary with the retaining wall system of the present invention. Also, the footing may be tiered. Also, the block 40 may be dry cast and is useful in combination with a rigid stabilizing element, such as element 42, as contrasted with geotextile materials.

Figure 28:
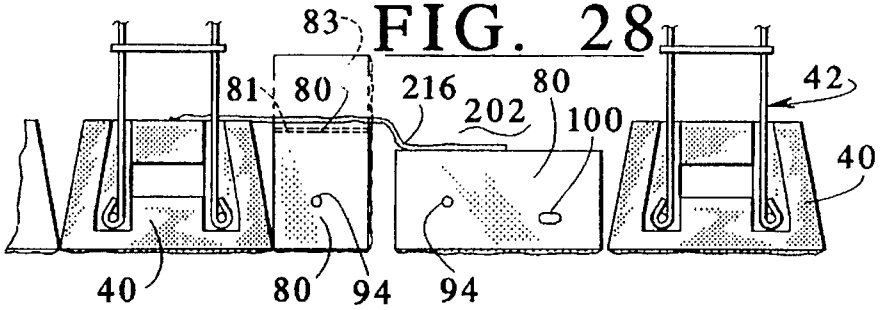
FIG. 28 is a sectional view of the wall shown in FIG. 27 taken substantially along the lines 28—28.
Figure 29:
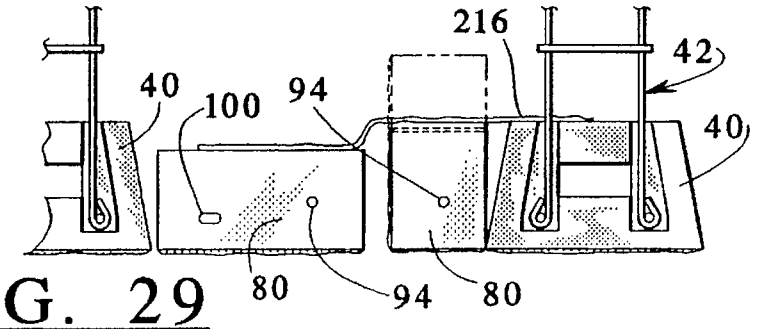
FIG. 29 is a sectional view of the wall of FIG. 27 taken substantially along the line 29—29.
Figure 27:
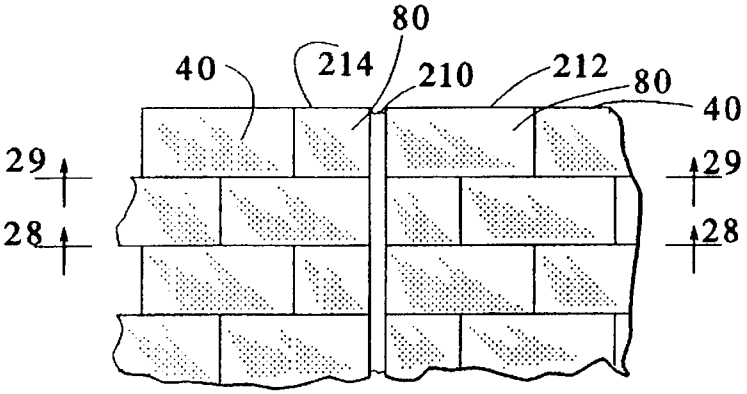
FIG. 27 is an enlarged front elevation of a retaining wall illustrating the manner in which a slip joint may be constructed utilizing the invention.

FIGS. 27, 28 and 29 illustrate the utilization of corner blocks to provide for a slip joint in a conventional wall of the type depicted in FIG. 26. As shown in FIG. 27, a slip joint or vertical slot 210 is defined between wall sections 212 and 214. Sectional views of the walls 212 and 214 are depicted in FIGS. 28 and 29. There it will be seen that the corner blocks 80, which may be turned in either a right handed or left handed direction, may be spaced from one another or positioned as closely adjacent as desired or required. A fabric or other flexible material 216 may be positioned along the back side of the blocks 80 and then backfill 202 positioned against the flexible material 216.

FIG. 29 illustrates the arrangement of these elements including the flexible barrier 216 and the blocks 80 for the next course of materials. It is to be noted that the first throughbore 94 of the corner blocks 80 as well as for the corner block 110 always align vertically over one another as each of the courses are laid. Thus, a rod 46 may be passed directly through the first throughbores 94 to form a rigidly held corner which does not include the capacity for adjustment which is built into the throughbores 62, 64 associated with the blocks 40 or the second throughbore 100 associated with corner blocks 80. The positioning of the throughbores 94 facilitates the described assembly. The blocks 80 may include a molded split line 81 during manufacture. The line 81 facilitates fracture of the block 80 and removal of the inside half 83 as shown in FIG. 28.

FIGS. 32, 33 and 34 illustrate a possible method for casting corner blocks 80. Corner blocks 80 may be cast in an assembly comprising four corner blocks wherein the mold provides that the faces 82, 85 of the corner blocks 80 will be in opposition along split lines 182, 185 so that, as depicted in FIG. 32, four corner blocks 80 may be simultaneously cast, or as shown in FIG. 34, two corner blocks 80 may be cast. Then as depicted in FIG. 33, the corner blocks may be split from one another along the molded split lines to provide four (or two) corner blocks 80.

The stabilizing elements 42, 44, may also be cooperative with the counterbores 103, 131 of the corner blocks 80, 110. In practice, such construction is suggested to stabilize corners of a wall. The elements 42, 44 would thus simultaneously cooperate with counterbores 103, 131 of a corner block 80, 110 and counterbores 70 or 72 of a modular block 40.

The described components and the mode of assembly of those components constitutes a preferred embodiment of the invention. It is to be noted that the corner blocks 80 as well as the standard modular blocks 40 may be combined in a retaining wall having various types of stabilizing elements and utilizing various types of analysis in calculating the bill of materials. That is, the stabilizing elements have both anchoring capabilities as well as frictional interactive capabilities with compacted soil or the like. Thus, there is a great variety of stabilizing elements beyond those specifically described which are useful in combination with the invention.

For example, the stabilizing elements may comprise a mat of reinforcing bars comprised of two or more parallel bars which are designed to extend into compacted soil. Rather than forming the loops on the ends of those bars to interact with vertical rods 46, it is possible to merely bend the ends of such rods at a right angle so that they will fit into the throughbores 62, 64 through the blocks 40 thereby holding mats or reinforcing bars in position. Additionally, the rods 46 may be directly welded to longitudinal tensile arms in the throughbores, thus, eliminating the necessity of forming a loop in the ends of the tension arms.

Though two tensions arms and thus two reinforcing bars are the preferred embodiment, a multiplicity of tension arms may be utilized. Additionally, as pointed out in the description above, the relative size of the corner blocks may be varied and the dimensional alternatives in that regard were described. The shapes of the rods 46 may be varied. The attachment to the rods 46 may be varied.

Figure 36:
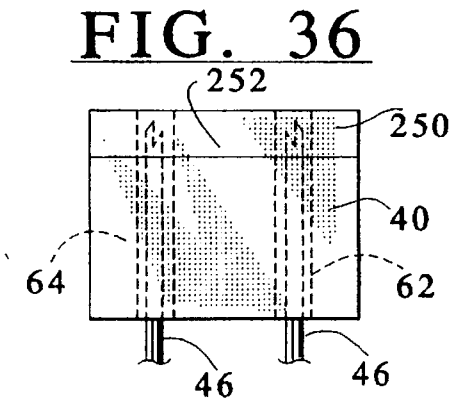
FIG. 36 is a front elevation of a wall construction with a cap block.
Figure 36A:
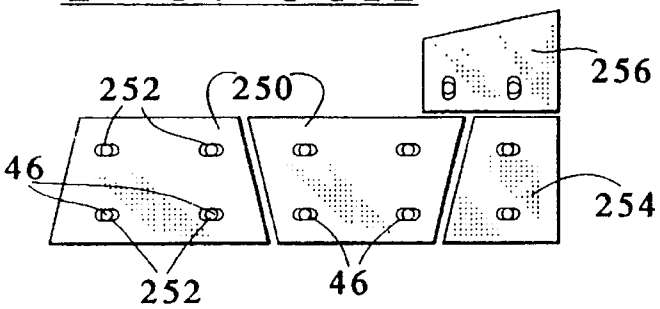
FIG. 36A is a top plan view of cap blocks forming a corner.

Also, cap blocks 250 may be provided as illustrated in FIG. 35 and 36. Such blocks 250 could have a plan profile like that of modular blocks 40 but with a longer lateral dimension and four throughbores 252, which could be aligned in pairs with throughbores 62, 64. The cap blocks 250 may then be alternated in orientation, as depicted in FIG. 35, with rods 46 fitting in proper pairs of openings 252. Mortar in openings 252 would lock the cap blocks 250 in place. Cap blocks 250 could also be split into halves 254, 256, as shown in FIG. 35, to form a corner. An alternative cap block construction comprises a rectangular shaped cap with a longitudinal slot on the underside for receipt of the ends of rods 46 projecting from the top course of a row of blocks 40. Other constructions are also possible.

Figure 37:
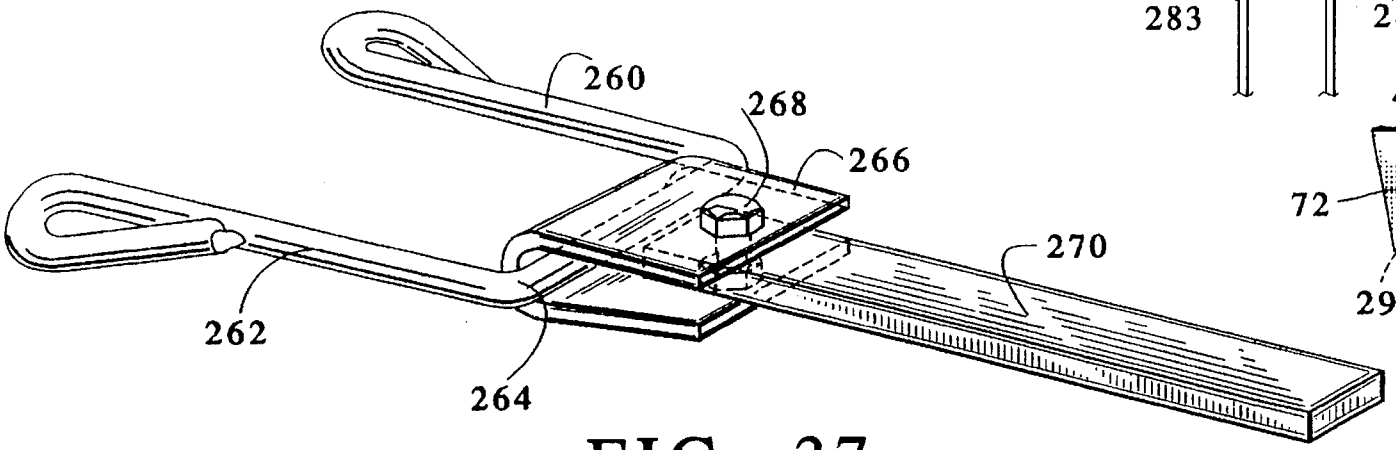
FIG. 37 is an isometric view of an alternative stabilizing element.

Another alternative construction for a stabilizing element is illustrated in FIG. 37. There, tension arms 260, 262 and cross members 264 cooperate with a clamp 266 which receives a bolt 268 to retain a metal strip 270. Strip 270 is designed to act as a friction strip or connect to an anchor (not shown).

Figure 38:
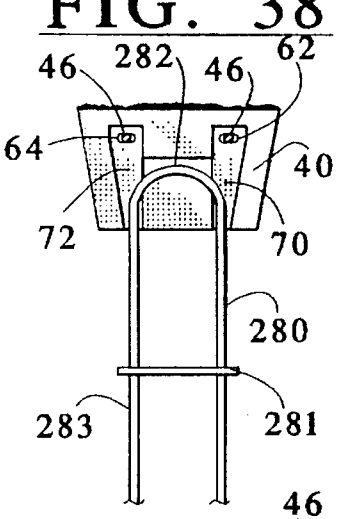
FIG. 38 is a bottom plan view of an alternative stabilizing element and wall block construction.

FIG. 38 depicts another alternative construction for a stabilizing element 280 and the connection thereof to block 40. Element 280 includes parallel tension arms 281, 283 with a cross member 282 which fits in the space between counterbores 70, 72 defined by passage 74. The shape of the walls defining the passage 74 may thus be molded to maximize the efficient interaction of the stabilizing element 280 and block 40.

Figure 39:
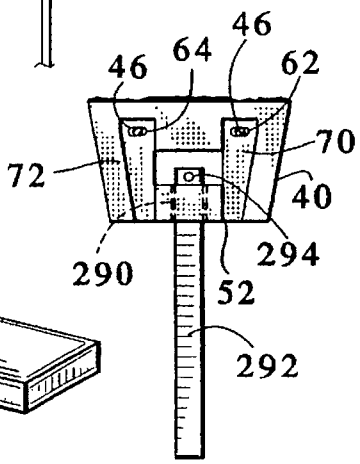
FIG. 39 is a plan view of another alternative stabilizing element and wall block construction.

FIG. 39 depicts yet another alternative construction wherein block 40 includes a passage 290 from internal passage 74 through the back face 52 of block 40. A stabilizing element such as a strip 292 fits through passage 290 and is retained by a pin 294 through an opening in strip 292. Strip 292 may be tied to an anchor (not shown) or may be a friction strip. Rods 46 still are utilized to join blocks 40.

Figure 41:
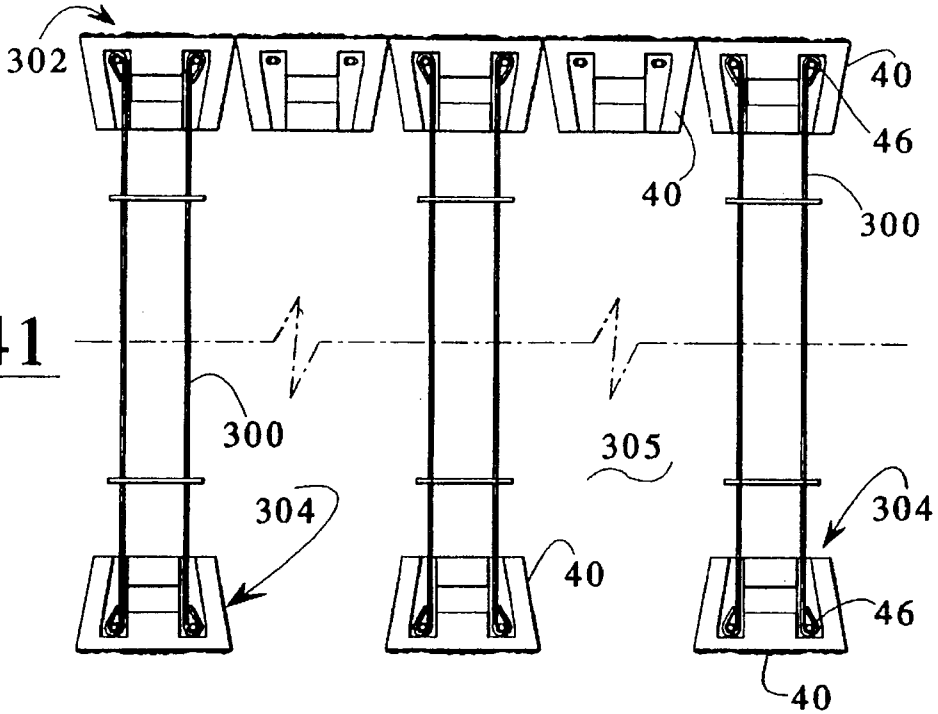
FIG. 41 is a bottom plan view of the wall construction of FIG. 40 taken along the line 41—41.

FIGS. 40 and 41 depict a wall construction comprised of blocks 40 in combination with anchor type stabilizing elements. The anchor type stabilizing elements are, in turn, comprised of double ended tensile elements 300 analogous to elements 42 previously described. The elements 300 are fastened to blocks 40 at each end by means of vertical rods 46. The blocks 40 form an outer wall 301 and an inner anchor 303 connected by elements 300. Anchors 303 are imbedded in compacted soil 302. The inside surface of the outer wall 301 may be lined with a fabric liner 311 to prevent soil erosion. This design for a wall construction utilizes the basic components previously described and may have certain advantages especially for low wall constructions.

Figure 42:
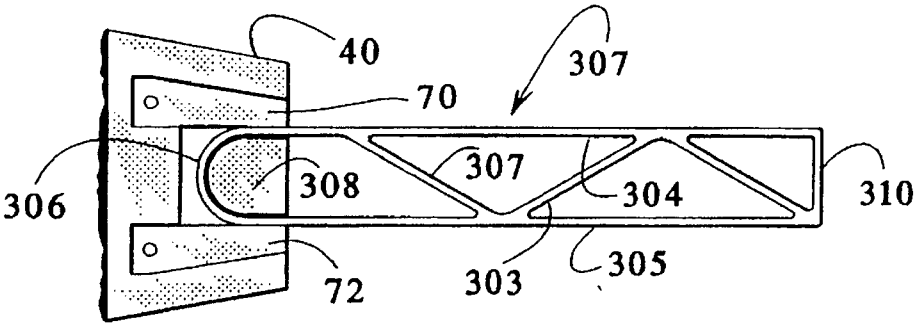
FIG. 42 is a top plan view of an alternative stabilizing element construction.
Figure 43:
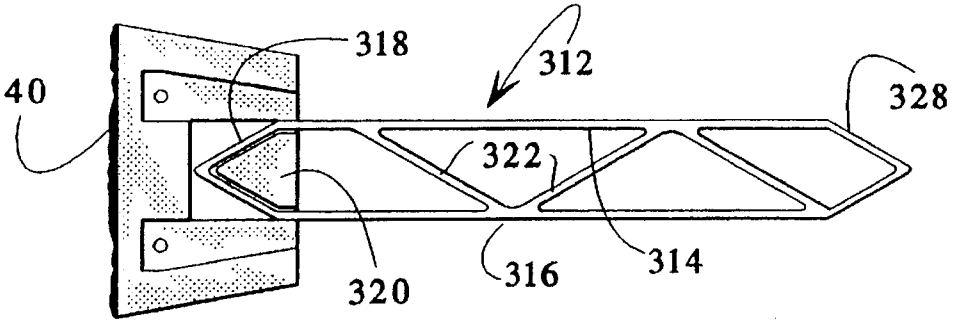
FIG. 43 is a top plan view of another alternative stabilizing element construction.
Figure 44:
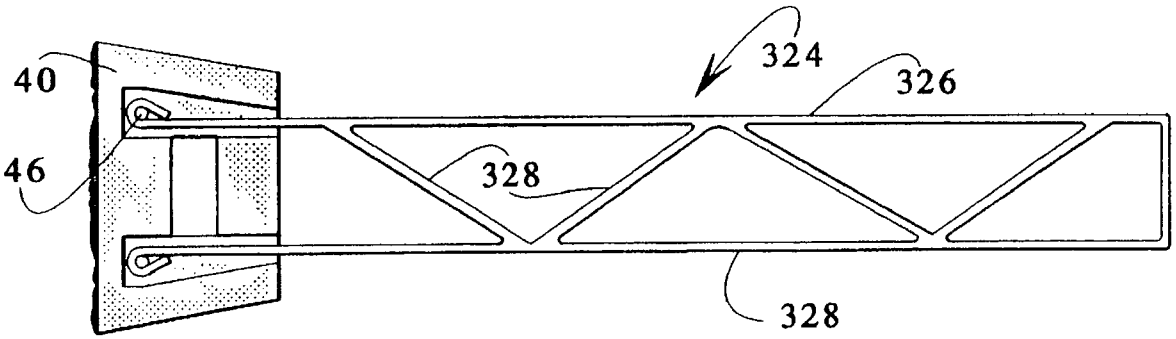
FIG. 44 is a top plan view of another stabilizing element construction.

FIGS. 42, 43 and 44 illustrate further alternative constructions for a stabilizing element 312 and a connection thereof to block 40. Reference is also directed to FIG. 38 which is related functionally to FIGS. 42, 43, and 44. Referring to FIG. 42, there is depicted a block 40 with a stabilizing element 312 comprised of first and second parallel arms 304 and 305 which are formed from a continuous reinforcing bar to thereby define an end loop 306 which fits over a formed rib 308 defined between the connected counterbores 70 and 72. This is analogous to the construction depicted in FIG. 38. The parallel arms or bars 304 and 305 are connected one to the other by cross members 307 and 309 which are connected to the arms 304 and 305 at an angle to thereby define a truss type construction. The ends of the arms 304 and 305 may be connected by a transverse, perpendicular cross member or cross brace 310.

Referring to FIG. 43, there is illustrated yet another alternative construction wherein a stabilizing element 313 is again comprised of parallel arms 314 and 316 which form a symmetrical closed loop construction including an end 318 having a generally V shape as depicted in FIG. 43 cooperative with a rib 320 defined in the block 40. Note that the cross members 322 are at an angle to define a truss type configuration. Further note that the V-shaped end 318 includes an opposite end counterpart 328 so that the entire stabilizing element 312 is generally symmetrical. It may or may not be symmetrical, depending upon desires.

FIG. 44 illustrates a variation on the theme of FIG. 43 wherein a stabilizing element 324 is comprised of arms 326 and 328 which cooperate with reinforcing bars 46 positioned in block 40 in the manner previously described. Crossing members 327 are again configured to define a generally truss shaped pattern analogous to the construction shown in FIGS. 42 and 43. Thus it can be seen that the construction of the stabilizing element may be varied significantly while still providing a rather rigid stabilizing element cooperative with blocks 40 and corner blocks as previously described.

Figure 46:
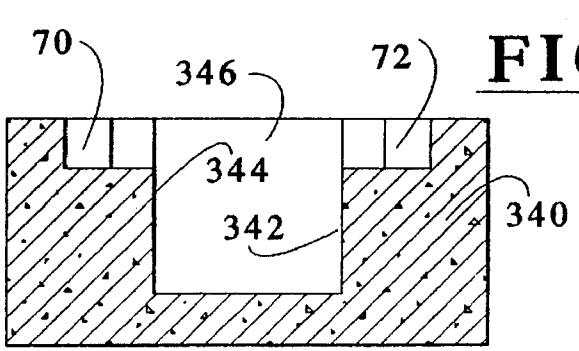
Figure 45:
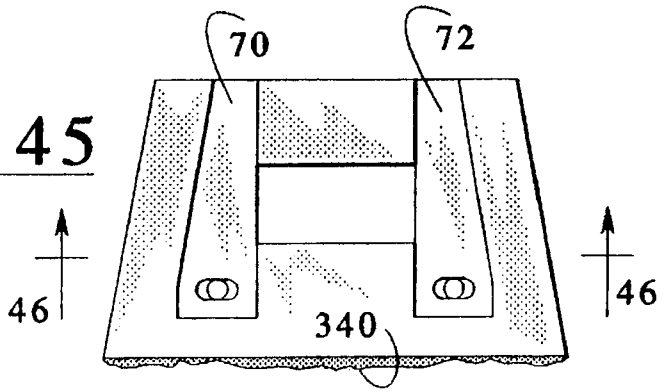
FIG. 45 is a bottom plan view of an alternative cap block construction.

FIGS. 45 and 46 illustrate an alternative to the cap block construction previously described. In FIG. 45, the bottom plan view of the cap block has substantially the same configuration as a face block 40. Thus cap block 340 includes counterbores 70 and 72 which are designed to be cooperative with stabilizing elements in the manner previously described. The passageways through the cap block 340, however, do not pass entirely through the block. Thus, as illustrated in FIG. 46, the cap block 340 includes counterbores 72 and 70 as previously described. A passageway for the reinforcing bars 46; namely, passage 342 and 344 extends only partially through the block 340. Similarly, the passage 346 extends only partially through the cap block 340. In this manner, the cap block 340 will define a cap that does not have any openings at the top thereof. The cap block 340 as depicted in FIGS. 45 and 46 may, when in a position on the top of the wall, have gaps between the sides of the blocks because of their tapered shape. Thus it may be appropriate and desirable to mold or cast the cap blocks in a rectangular, parallelpiped configuration as illustrated in dotted lines in FIG. 45. Alternatively, the space between the blocks 340 forming the cap may be filled with mortar or earthen fill or other fill.

Alternative Wall Constructions

Referring next to FIG. 47, there is depicted a further alternative embodiment of the invention. In this embodiment, facing blocks 400 include a front face 402 converging side walls 404 and 406 and a back face 408. The front face 402 may be textured, etc. in the manner previously described. A series of counterbores 410, 411 and 412 are arranged in parallel array and extend from adjacent the front face 402 and project through the back face 408. The counterbores 410, 411 and 412 are parallel and are defined in a bottom surface 414 in FIG. 48 or a top surface 416 in FIG. 48. The counterbores 410, 411 and 412 are interconnected by a cross counterbore 418 which is generally perpendicular to the counterbores 410, 411 and 412 and which is positioned adjacent to and parallel to the front face 402. Vertical throughbores 420 and 422 are defined through the block 400 and extend into the cross counterbore 418.

In a wall construction, a series of the blocks 400 are arrayed in horizontal layers. The blocks 400, thus, define courses which are arranged in horizontal layers with one row upon the other. The blocks 400 preferably overlap one another. That is, vertically adjacent blocks 400 overlap one another. The throughbores 420 and 422 are preferably arranged in the modular array previously disclosed. That is, the spacing of the throughbores 420 and 422 is equal to one half the width dimension of the front face 402. The throughbores 420 and 422 are set inwardly from the vertical side edges of the front face 402 one quarter of the width dimension of the front face between the side edges. In this manner, the throughbores 420 and 422 can serve as passages for receipt of connector pins or rods 424 as shown in FIG. 48 to connect the facing blocks 400 which are vertically adjacent and over lapping one another.

Coacting with the array of facing blocks 400 is a continuous wire mesh or wire sheath comprised of tension arms or tension members 428 which extend generally from adjacent the front face 402 into compacted soil 429 behind the back face 408. Cross members 430 interconnect the tension members 428. An outside cross member 432 connects the tension arms or tension members 428 and fits within the cross counterbore 418. Cross member 432 extends along the length of that counterbore of adjacent facing blocks 400. In this manner, the facing blocks 400 are generally interconnected by means of a rigid cross member 432. Typically, the cross member 432 will be welded to the tension members 428 as depicted in FIG. 48.

Alternatively, as depicted in FIG. 48, the end 436 of the tension arms 428 may be formed as a loop which is retained in the cross counterbore 418. A cross bar 438 will then fit through the end loop 436 and serve to retain the tension rods 428 in the block 400. Note that in FIG. 48 there is depicted the positioning of the counterbore 410 vertically upward as well as vertically downward. Either orientation may be utilized when building a wall utilizing the components of the present invention.

Figure 49:
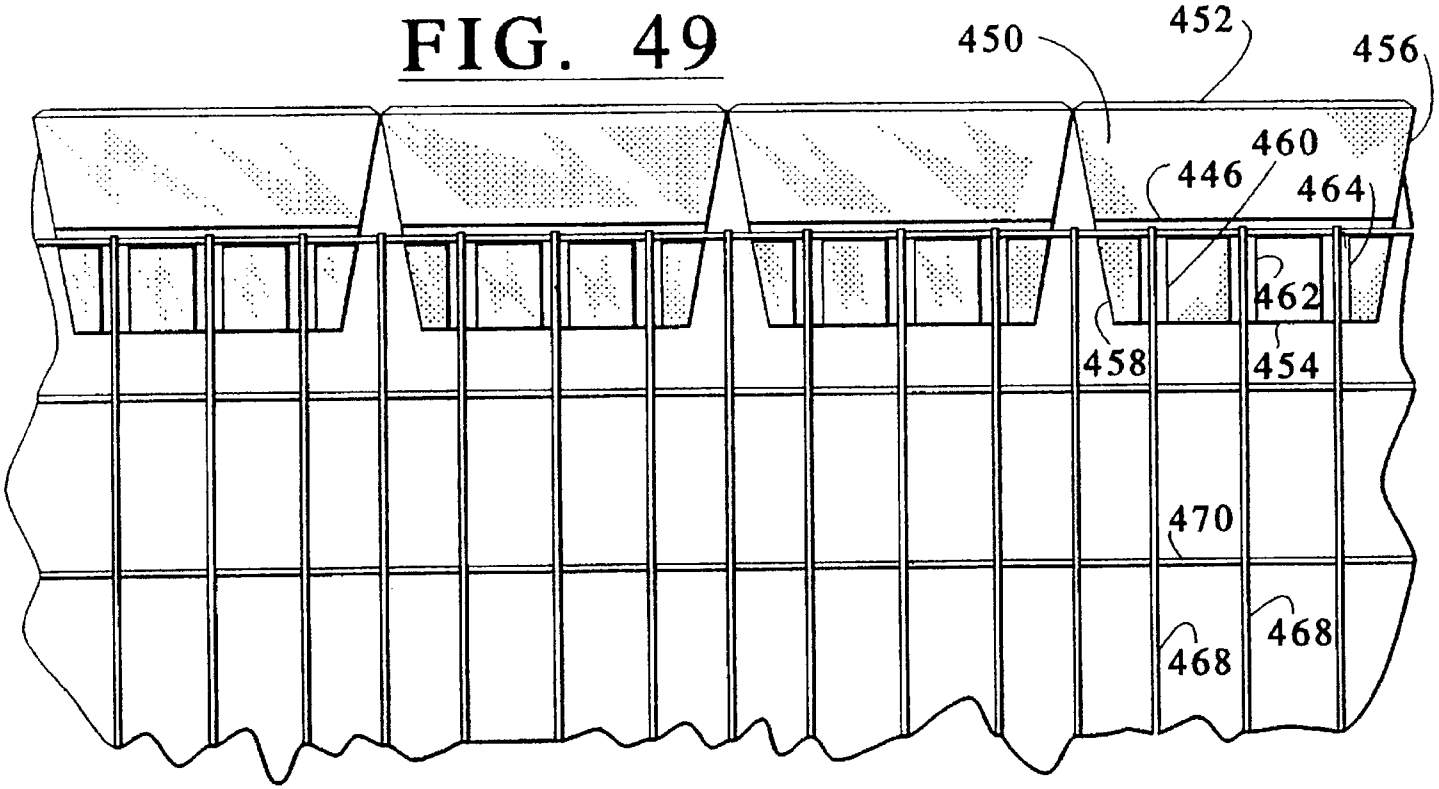
FIG. 49 is a top plan sectional view of another alternative construction utilizing modular facing blocks in combination with a wire grid.
Figure 51:
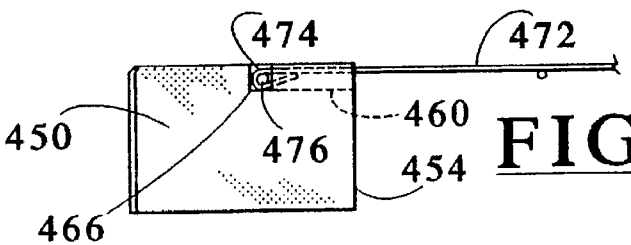
FIG. 51 is a side sectional view of an alternative to the construction of FIG. 50.
Figure 50:
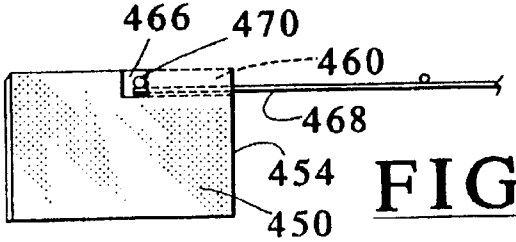
FIG. 50 is a side section view of the construction of FIG. 49.

FIG. 49 illustrates another variation of the invention. Referring to the top plan view in FIG. 49, a facing block 450 includes a front face 452, a back face 454, side walls 456 and 458, and parallel counterbores 460, 462 and 464 extending from adjacent front face 452 through the back face 454. Cross counterbore 466 extends between the sidewalls 456 and 458. As a result of this configuration of counterbores 460, 462, 464 and 466, defined in either the top or bottom parallel face of block 450, there is provided a series of channels which are adapted to receive a grid wire comprised of grid tension members 468 and cross members 470. This particular construction is useful for building lower gravity type walls inasmuch as there is no specific vertical interconnection of the facing blocks 450. FIG. 50 illustrates, in cross sectional view, the position of the wire grid in the channels defined by the counterbores 460 and 466 of block 450. FIG. 51 illustrates an alternative construction for the wire grid. Tension members 472 are provided. A loop 474 is formed at the end of the tension members 472, and a cross bar 476 is fitted through that loop. The construction fits into the counterbores 460 and 466 in a matter similar to that depicted in FIGS. 49 and 50.

FIGS. 52, 53, 54 and 55 illustrate another variation of the wall construction utilizing horizontal rows of facing blocks 550 which are offset inwardly one with respect to the other. As depicted in FIG. 52, blocks 550 include a lower depending lip 552 adjacent to the back face or wall 553 of the block 550. The blocks 550 also include a first set of vertical throughbores 554 and a second set of vertical throughbores 555 behind the first set 554. As shown in FIG. 53, the throughbores 554 and 555 are arranged in position within counterbores 556 and are arranged one behind the other between the front wall 551 and the back wall 553. As in any of the blocks which are described herein, a throughbore or core 558 may be provided to reduce the weight of the block.

In any event, the lip 552 associated with the blocks 550 necessitates offsetting the horizontal rows of blocks 550 as the horizontal courses are laid one upon the other. The offset associated with the lip 552 equals to the offset of the centers of the vertical throughbores 554 and 555. In this manner, vertical pins or rods 562 may be inserted through the first throughbore 554 of a block 550 and downwardly into the second throughbore 555 of the next lower block 550. This will lock the blocks 550 together and also hold a horizontal stabilizing element, such as element 564, in position. The stabilizing element 564 is similar to that depicted in FIG. 14, for example, although numerous types of stabilizing elements as described herein may be utilized in combination with the block 550.

Figure 54:
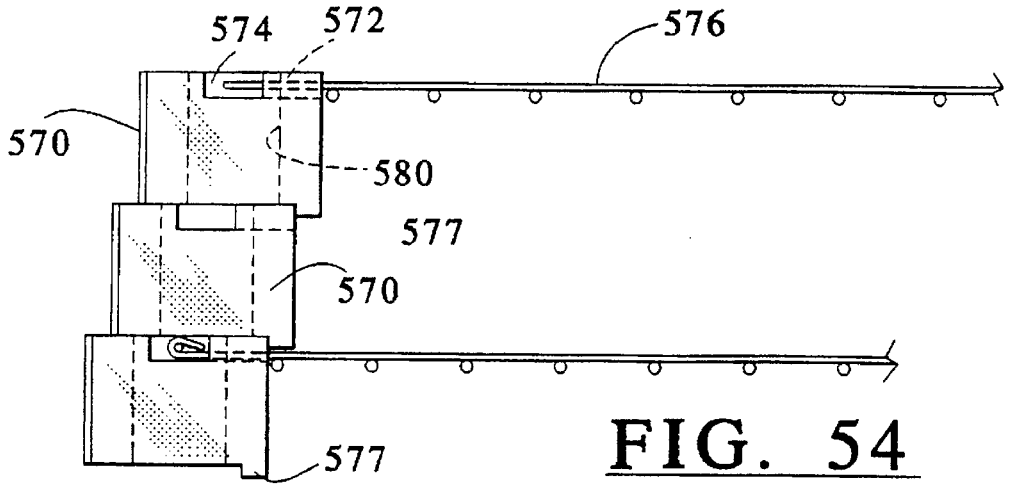
FIG. 54 is a side sectional view of alternatives to the construction depicted in FIG. 52.
Figure 55:
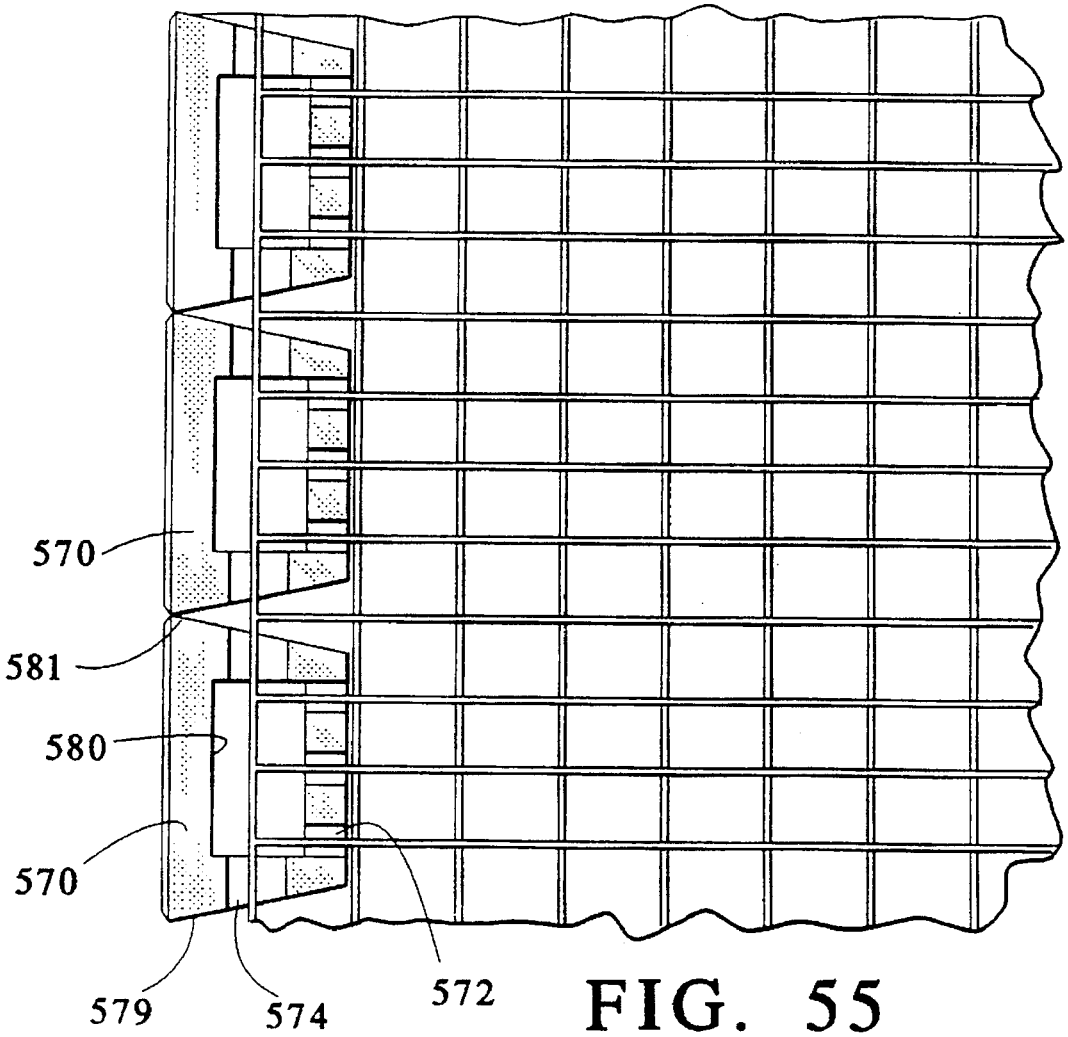
FIG. 55 is a top plan sectional view of an alternative construction depicting an alternative facing block construction which is similar to the construction of FIG. 49.

As illustrated in FIG. 54, blocks 570 may be provided with counterbores 572 and cross counterbores 574 for cooperation with a wire mesh mat 576 in a fashion similar to that previously described with respect to FIGS. 47 and 49. Again note that the facing block 570 includes a depending lip or rib 577 for block offset and may also include a center throughbore opening 580 to reduce block weight. Also, note that the side walls 579, 581 of the block 570 are converging to permit formation of various kinds of curves although such convergence is an optional feature of the block 570.

Figure 56:
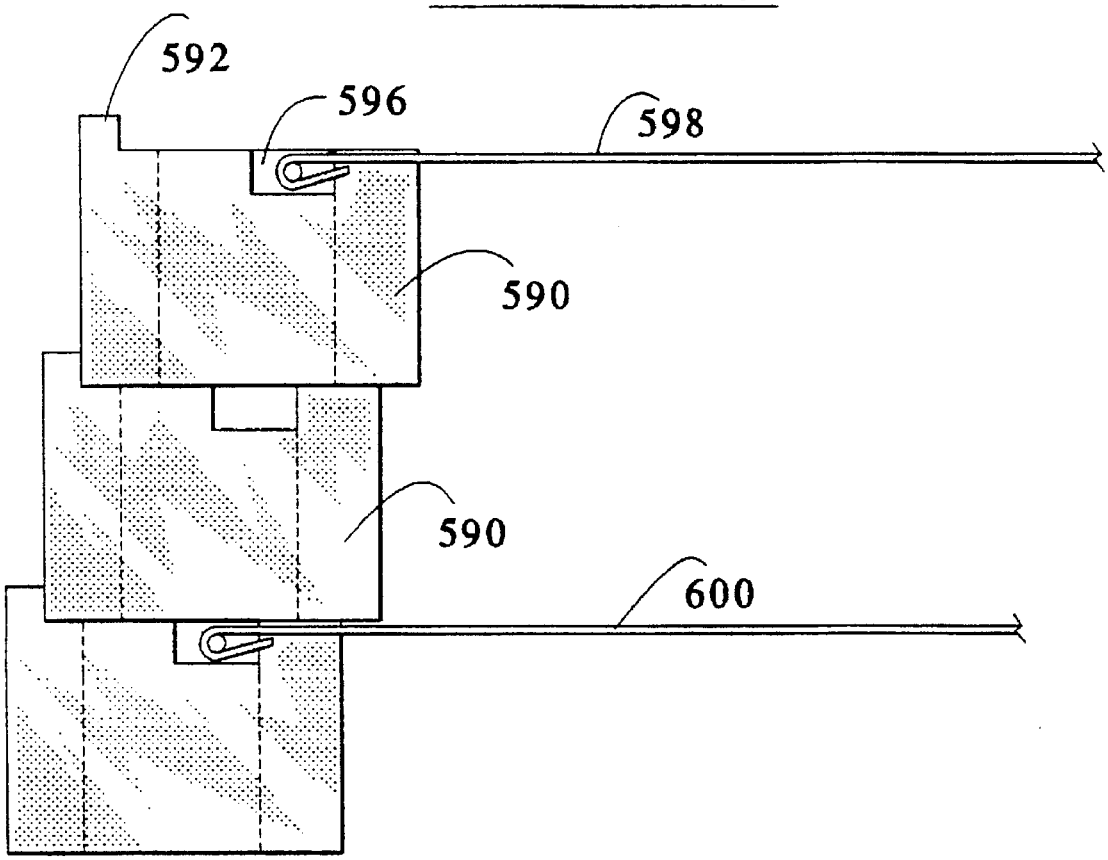
FIG. 56 is a side sectional view of another alternative construction utilizing a modified facing block configuration.
Figure 57:
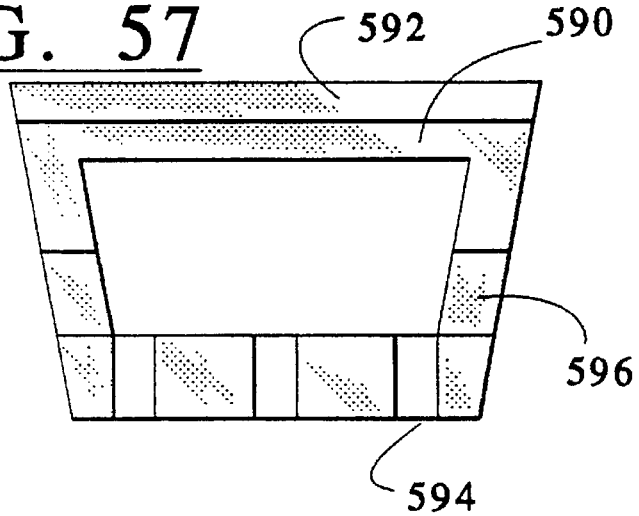
FIG. 57 is a top plan view of the facing block used in the construction of FIG. 56.

FIGS. 56 and 57 depict a variation of a facing block construction wherein facing blocks 590 are provided with lips 592 along the front edge thereof to effect horizontal offset. The blocks 590 are otherwise configured to include counterbores 594 and cross counterbores 596 for cooperation with mats, such as mats 598 or 600, in the manner described herein.

Figure 58:
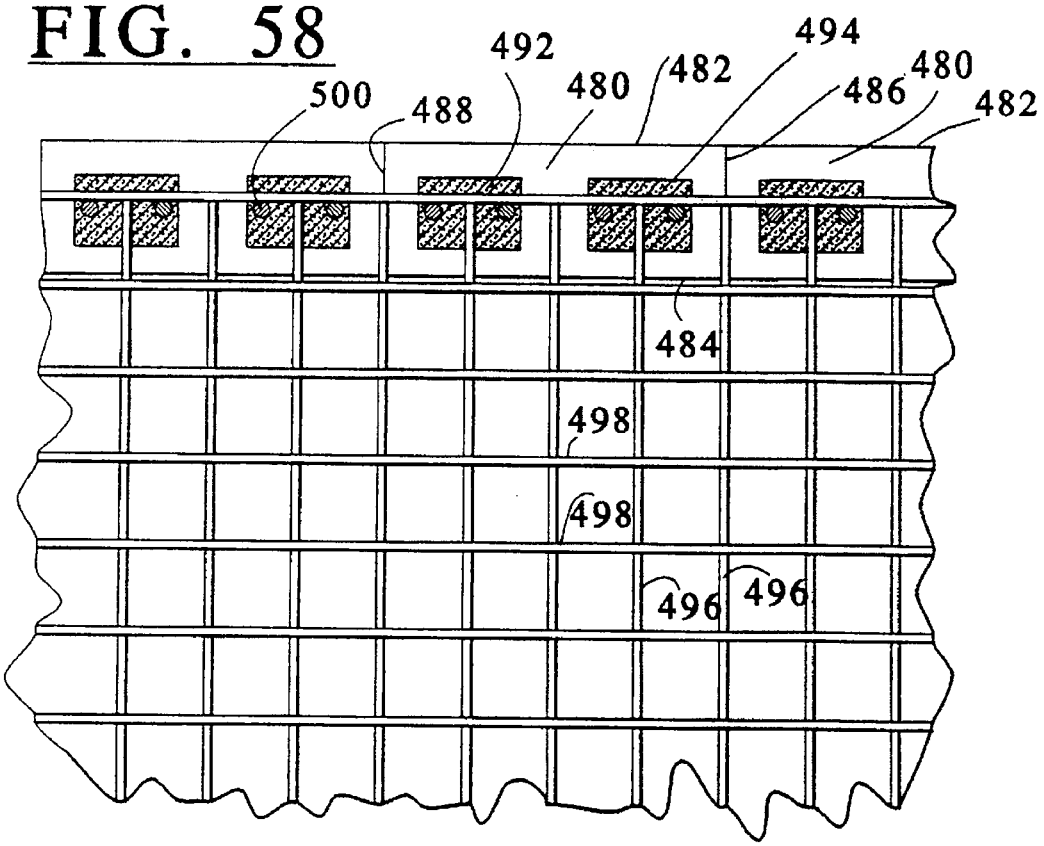
FIG. 58 is a top plan sectional view of yet another alternative construction utilizing a modular facing block in combination with a wire mesh.
Figure 59:
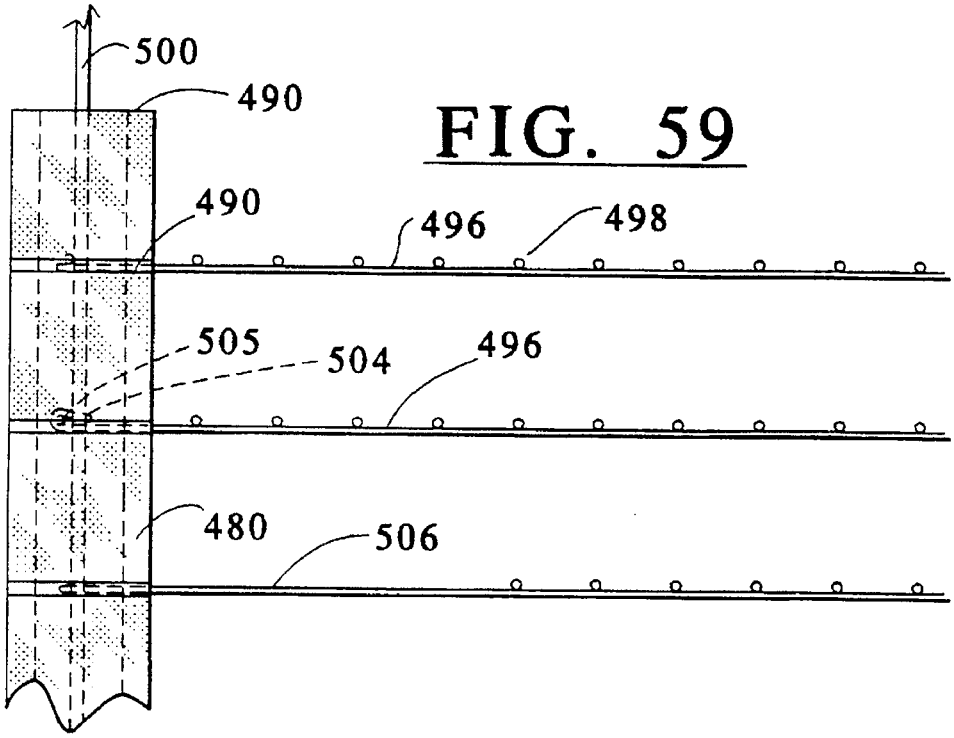
FIG. 59 is a side sectional view depicting various alternative combinations of a wire mesh and block as depicted in FIG. 58.

FIGS. 58 and 59 illustrate yet another variation of a wall block and wall construction. Here, standard dry cast concrete block 480 of the type having a generally flat front wall 482, a back wall 484, and side walls 486, 488 are cast in the form of rectangular parallelpiped having a top surface 490 and throughbores 492 and 494. A wire mesh comprised of tension members 496 and cross members 498 is held in position on the face 490 of the block 480 by means of vertical reinforcing bars 500. The reinforcing bars 500 may be extended through vertically adjacent blocks 480 inasmuch as the throughbores 492, 494 of such blocks 480 will overlap one another. The reinforcing bars 500 may be typical steel reinforcing rods. Fill material may be used such as sand or gravel. Alternatively, concrete or mortar may be inserted into the throughbores 492 and 494. The bars 500 capture or retain the cross bars 498. The adjacent horizontal rows of blocks 480 are typically separated by a mortar joint so as to provide spacing for receipt of members 496.

Figure 60:
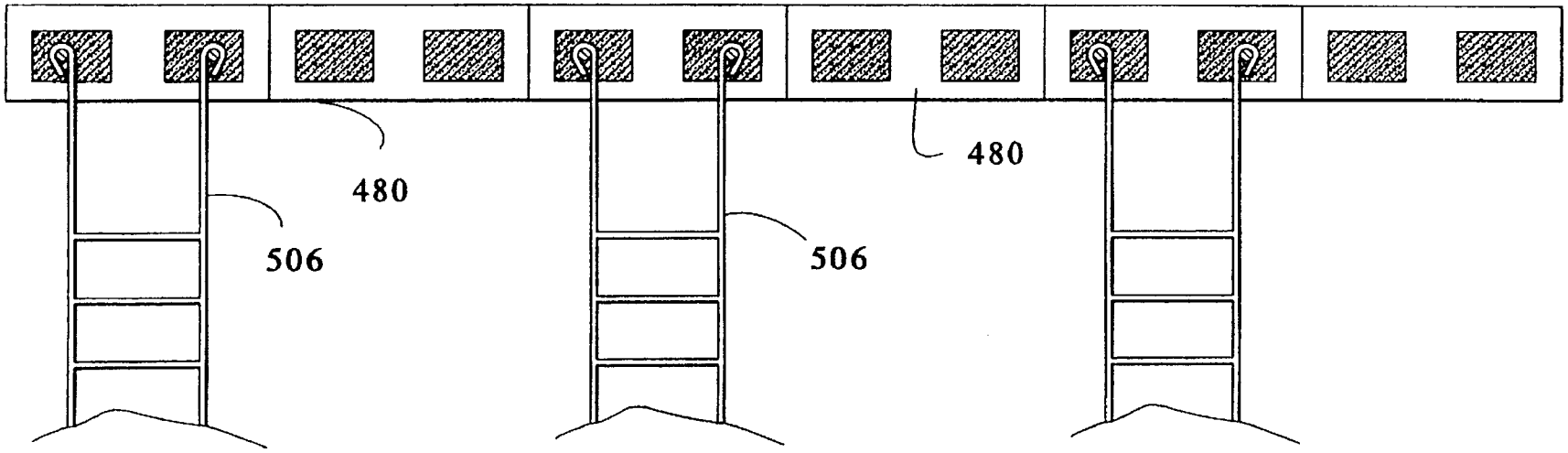
FIG. 60 is a top plan view of another modification of the construction depicted in FIG. 58.

Side elevation, FIG. 59, illustrates various alternative constructions for connection of the wire grid to the blocks 480. The upper part of FIG. 59 has the construction described and depicted by FIG. 58. Alternatively tension members 496 have loop ends 504. The loop ends 504 coact with cross bars 505. As another alternative, a stabilizing element 506 in FIG. 59 is depicted in greater detail in FIG. 60 and is actually the same as the stabilizing element depicted in FIG. 14. In other words, numerous types of stabilizing elements may be used in combination with the block 480 arrangement depicted in FIGS. 58 and 59 including an arrangement as depicted in FIG. 60 wherein the block 480 cooperates with the stabilizing element 506 and vertical reinforcing bars 500 which are imbedded preferably in concrete which fills the throughbores such as throughbore 492 in the block 480.

Figure 61:
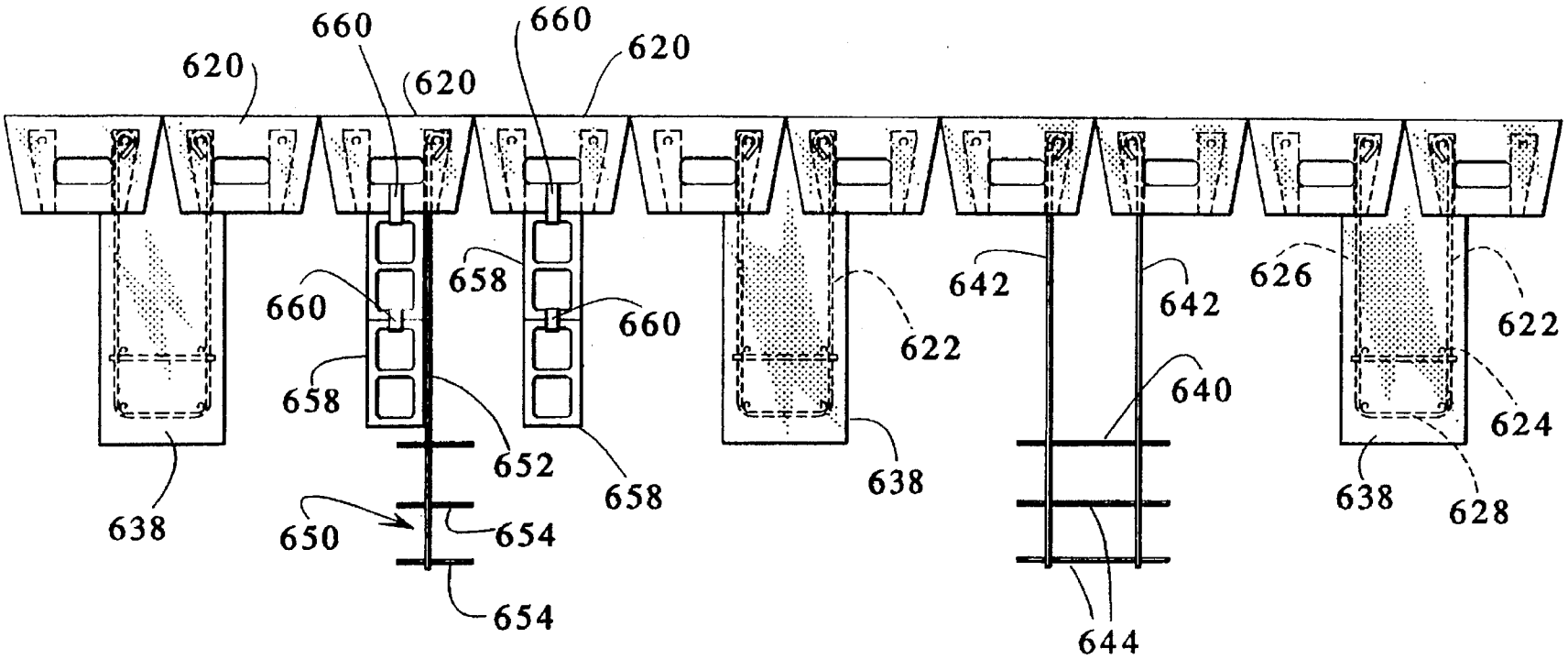
FIG. 61 is a top plan sectional view of another alternative embodiment of the invention utilizing tension arms and tension members in combination with facing blocks and various connector pins and a cast in place counterfort.

Reference is next directed to FIGS. 61, 62, 63 and 64 wherein the concepts of the invention are incorporated with and combined with a cast in place counterfort. Thus, referring to these figures, there is depicted a wall in FIG. 61 having a series of facing blocks 620 which are arrayed in horizontal layers one over the other with the blocks being offset with respect to each other. The blocks 620 may be any one of the particular constructions heretofore described. The block described and depicted in FIG. 2, for example, may be used along with stabilizing members 622 of the type depicted in FIG. 14. The stabilizing member 622 includes tension arms 624 and 626 which are positioned within counterbores in the manner previously described to cooperate with vertical pin members again in the manner previously described. As shown in FIG. 61, the stabilizing members 622 may be used to connect the horizontally adjacent blocks 620 or may be connected to one of such blocks 620. The stabilizing members 622 include a connecting cross member 628 which is positioned some distance from the back of the blocks 622.

Figure 62:
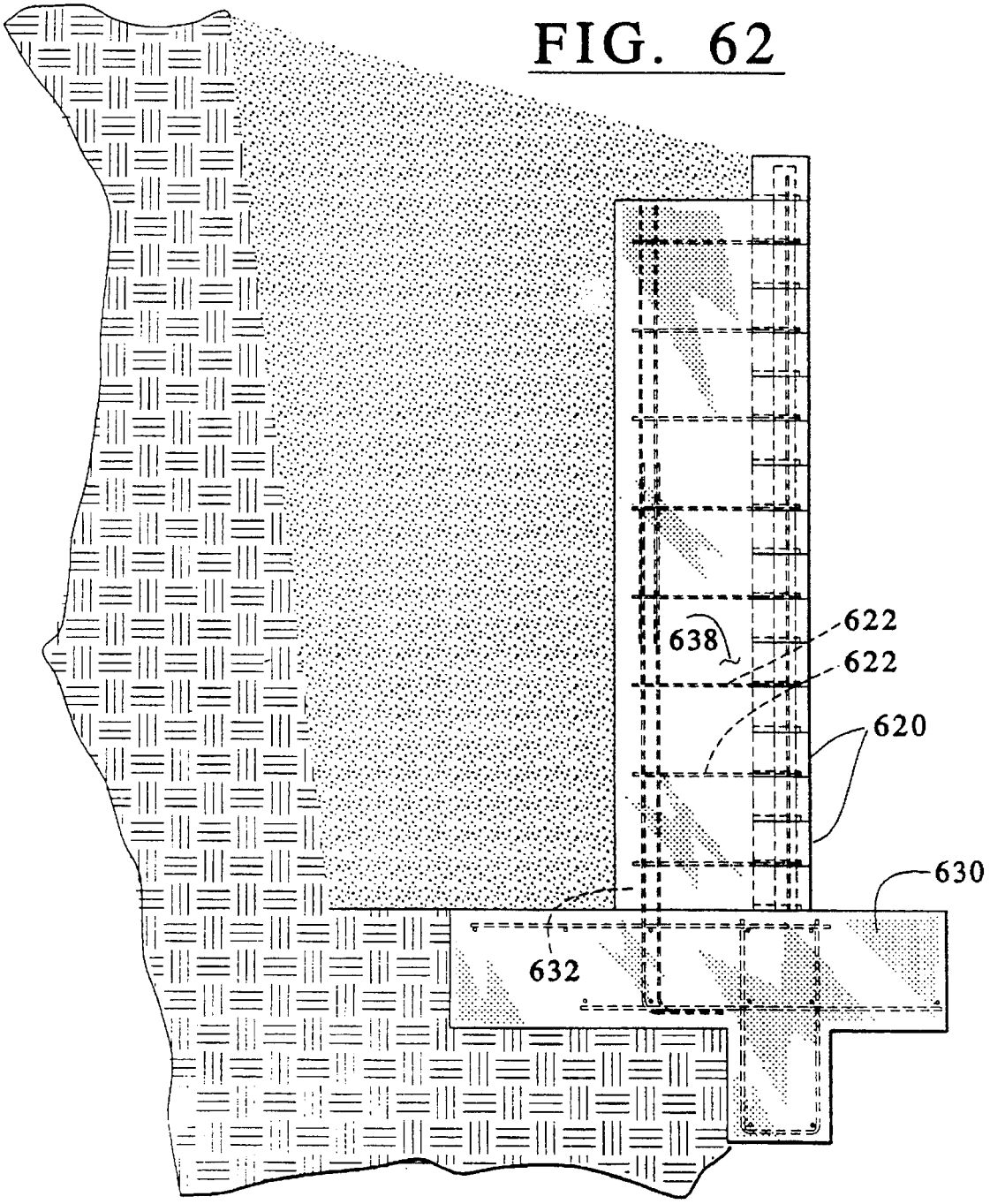
FIG. 62 is a side sectional of the construction depicted in FIG. 61.

To construct a counterfort, a series of the stabilizing elements 622 are arrayed vertically one over the other in the manner depicted in FIG. 62. The entire assembly is preferably positioned on a precast footing 630 having reinforcing bars 632 projecting from the footing 630 upwardly and retained between the loops or bars forming the stabilizing elements 622. It should be noted that, with respect to the counterfort construction of FIGS. 61 through 64, the vertical reinforcing members 632 which extend upwardly into the cast in place counterfort member are preferably included and are preferably connected with the cast in place footing 630.

Figure 63:
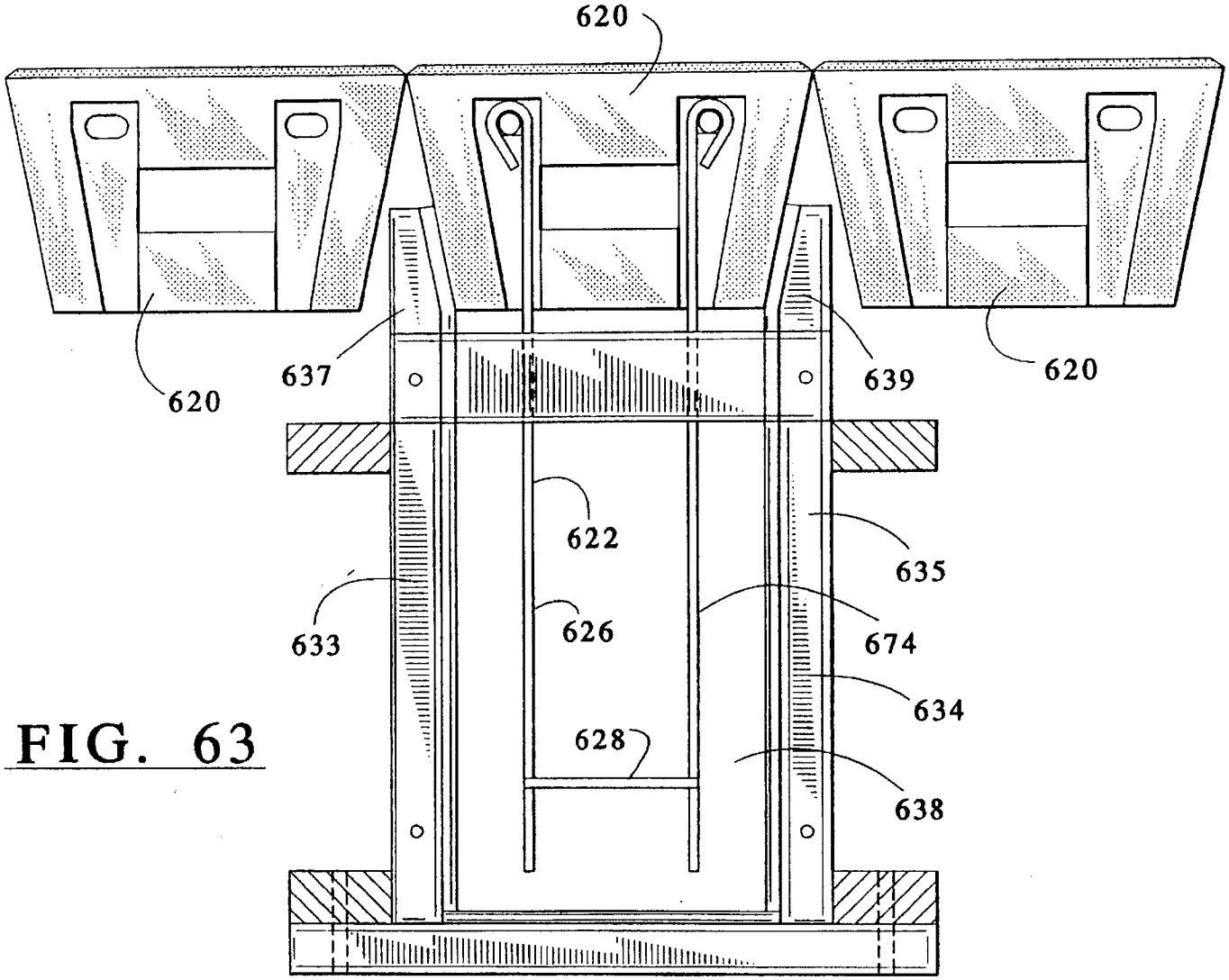
FIG. 63 is a top plan view of an alternative design and the form for the cast in place counterfort similar to the construction shown in FIG. 61.
Figure 64:
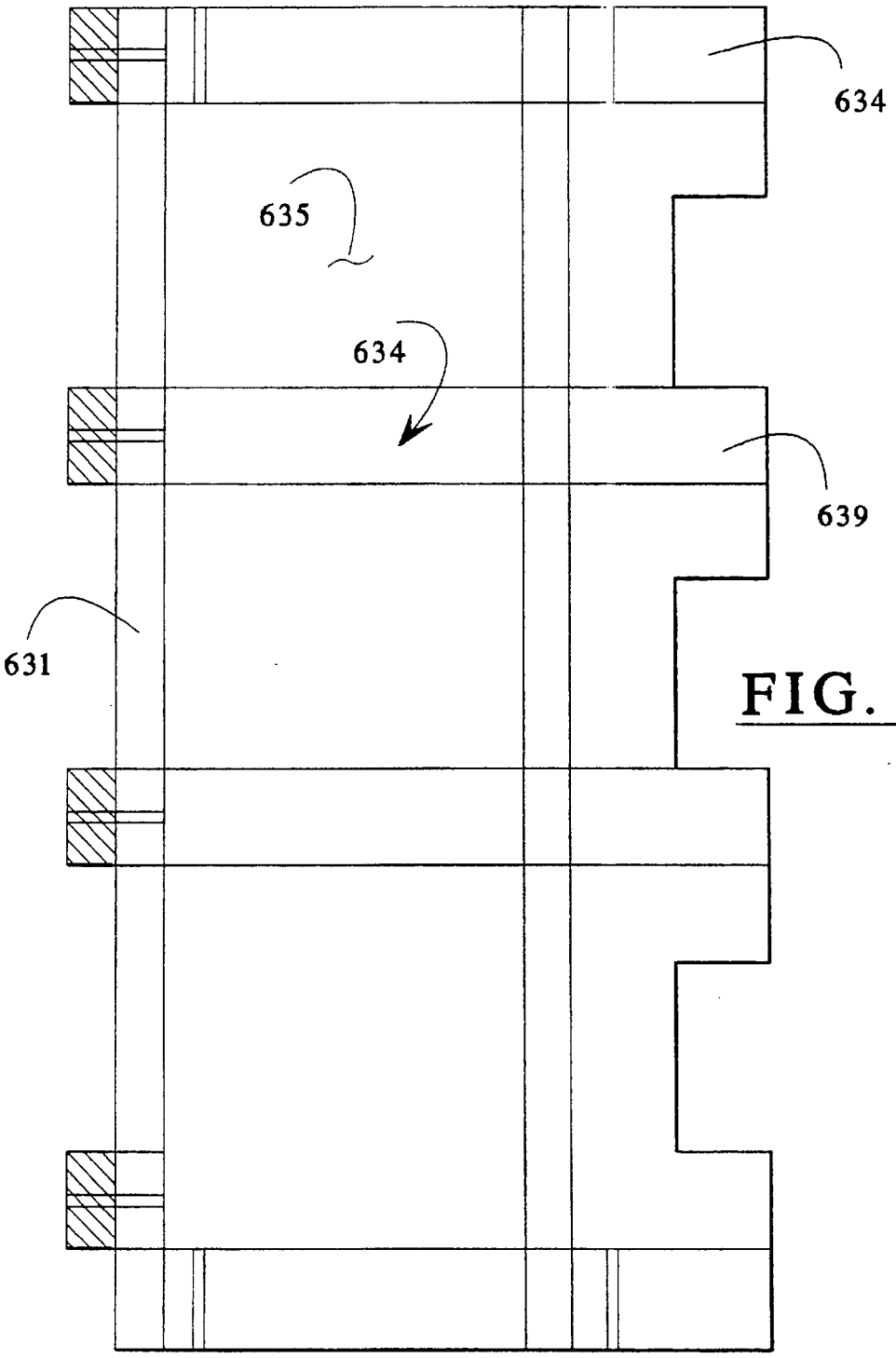
FIG. 64 is a side elevation of the forms of FIG. 63.

A concrete form such as the form 634 depicted in FIGS. 63 and 64 is fitted over the stabilizing elements 622 and against the back side of facing blocks 620. Form 634 includes a back wall 631, side walls 633, 635 and block engaging ends 637, 639. A cast in place counterfort 638 is then cast. The form 634 may have the width of a single facing block 620 to provide a counterfort 638, or the width of more than one block 620. Inasmuch as the facing blocks 620 overlap one another in vertically adjacent rows, the form 634 of FIG. 63 will, in fact, engage with and interact with single and adjacent facing blocks 620 at different vertical elevations of the counterfort 638.

Additionally, it should be noted that the facing block 620 may interact with and be utilized with all of the various types of stabilizing and anchor elements heretofore described. For example, a ladder reinforcing element 640 may include tension rods 642 and cross members 644 which extend laterally beyond the generally parallel tension rods 642. The stabilizing member may also be, as depicted in FIG. 61, a member 650 which includes a single tension arm 652 having cross members 654 attached thereto.

Still another form of stabilizing element used in combination with blocks 620 is depicted in FIG. 61. Specifically, one or more concrete blocks 658 are connected, end to end, to the back side of a facing block 620. Metal clips or other fasteners 660 connect the blocks 658 together as depicted.

Thus, there are numerous variations of the construction. The invention, therefore, has many variations and is only to be limited by the following claims and equivalents.

What is claimed is:

1. An improved wall construction comprising, in combination:

a plurality of facing block members arrayed in overlapping courses, one upon the other, each block member having a generally planar front face, a back face, first and second side faces from the front face to the back face, and generally parallel, planar top and bottom surfaces extending from the front face to the back face;

each block member also including at least two generally parallel counterbores in one of the parallel top and bottom surfaces extending from adjacent the front face through the back face, and a cross-counterbore connecting the parallel counterbores, each block member also including at least two bores in the parallel counterbores extending into the block for receipt of a pin, said two bores aligned with bores of vertically adjacent blocks extending into the blocks;

stabilizing elements, at least one of said stabilizing elements including a pair of tension arms positioned in the counterbores of selected block members, each pair of said tension arms of each such stabilizing element being generally parallel and connected together by a cross member positioned in the cross-counterbore, said stabilizing elements also including soil engaging means extending therefrom projecting away from the back face of each block into compacted soil;

pins in the bores of overlapping courses of blocks to hold the blocks one upon the other; and compacted soil for receipt of the soil engaging means for engagement with the soil.

2. The wall construction of claim 1 wherein each of the block members is substantially identical and the block members of adjacent courses are offset laterally with respect to each other.

3. The wall construction of claim 1 wherein each pair of connected tension arms are connected together by cross members in the compacted soil.

4. The wall construction of claim 3 wherein cross members are positioned in compacted soil behind the back face of the block members, said soil defining an active zone and a resistive zone.

5. The wall construction of claim 4 wherein the cross members in the resistive zone are uniformly spaced.

6. The wall construction of claim 1 wherein the bores comprise throughbores in the block members extending from counterbores through the top surface or the bottom surface of each block.

7. The wall construction of claim 6 wherein the throughbores are elongated slots generally parallel to the front face of the block member.

8. The wall construction of claim 6 wherein the throughbores each define a centerline axis which is approximately one quarter of the distance from a side edge of the front face of the block member.

9. The wall construction of claim 1 wherein the block members of vertically adjacent courses include front faces which are generally vertically aligned.

10. The wall construction of claim 1 wherein the stabilizing elements comprise an elongated generally rigid, friction member extending from the back face into compacted soil.

11. The wall construction of claim 1 wherein the tension arms of a stabilizing element in a block member are joined by a cross member adjacent to the back face and further including a band looped over the cross member which extends into compacted soil.

12. A wall constructions of claim 1 wherein the soil engaging means are rigid metal tensile members.

13. The wall construction of claim 1 wherein the soil engaging means comprise two parallel rigid metal tensile bars projecting into a resistive zone and providing generally equal tensile forces on each bar.

14. The wall construction of claim 1 wherein the stabilizing elements comprise at least in part a flexible polymeric material.

15. The wall construction of claim 1 wherein the block includes fiber reinforcement material.

16. The wall construction of claim 1 wherein the stabilizing elements include a rigid metal strip.

17. The wall construction of claim 1 wherein the stabilizing elements include tensile members and an anchoring member, said anchoring member connected to the tensile members.

18. The wall construction of claim 1 wherein the block is dry cast and is assembled in combination with rigid, metallic stabilizing elements.

19. The wall construction of claim 1 wherein stabilizing elements comprise first and second spaced tensile members extending into the compacted soil as the soil engaging means, and further including cross-members connecting the tensile members.

20. The wall construction of claim 19 wherein at least some of the cross-members are at substantially right angles to the tensile members.

21. The wall construction of claim 19 wherein at least some of the cross-members form a truss construction in combination with the tensile members.

22. The wall construction of claim 1 including a corner block at a terminal edge of a course of the wall, said corner block including a front face, with parallel side edges, a finished side face at a generally right angle to the front face, a generally parallel top surface and bottom surface, a back face.

23. The wall construction of claim 22 wherein the corner block further includes a counterbore in at least one of the top and bottom surface from adjacent the front face through the back face.

24. The wall construction of claim 22 wherein the top surface and bottom surface of the corner block are flat planar surfaces.

25. The block of claim 1 wherein the bores extend partially through the block from the bottom surface toward the top surface.

26. A wall construction comprising, in combination:

a plurality of facing block members arrayed in generally horizontal, overlapping courses one upon the other, each block member having a generally planar front face, converging sides, a back face, and generally parallel top and bottom surfaces;

each block member also including at least one counterbore in one of the parallel top and bottom surfaces extending from adjacent the front face through the back face;

a stabilizing element comprising a tension arm in the counterbore of selected block members;

the stabilizing element further including soil engaging means extending therefrom projecting away from the back face of each block into compacted soil;

compacted soil for receipt of the soil engaging means for engagement with the soil;

a vertical throughbore in the block members connected to the counter bore, the throughbores of vertically adjacent block members being aligned; and a pin within the throughbores of selected vertically adjacent block members to retain the stabilizing element and to simultaneously interlock the block members.

27. The wall construction of claim 26 wherein each of the block members is substantially identical and the block members of adjacent courses are offset laterally with respect to each other.

28. A counterfort wall structure comprising, in combination:

modular wall facing blocks including a front face, sides, a back face, generally parallel top end bottom surfaces, said blocks arrayed in a multiple number of generally horizontal rows stacked one upon the other with vertically adjacent blocks overlapping one another, at least some of said blocks further including at least one counterbore in the top or bottom surface thereof extending from adjacent the front face through the back face, said counterbore connected to a generally vertical throughbore in the block;

a vertical array of tension members connected simultaneously to horizontally adjacent blocks, said tension members comprising first and second generally parallel tension arms positioned respectively in counterbores of said horizontally adjacent blocks, said tension arms extending outwardly from the back face of the blocks and connected by at least one cross member to define a plurality of vertically aligned tension arms and cross members;

linking members in the throughbores for simultaneously linking vertically adjacent facing blocks and for retaining the tension arms in the counterbores; and a cast in place counterfort defining a beam enclosing the tension members.

29. The structure of claim 28 also including vertical reinforcing members in the cast in place counterfort, said vertical reinforcing members extending vertically between at least two horizontally spaced tension members.

30. The structure of claim 28 also including compacted particulate adjacent the back face of the facing blocks, and tension members projecting into the particulate, said tension members also connected with facing blocks.

31. The structures of claim 30 including tension arms having at least one cross member connected thereto and projecting laterally from the arms in opposite directions.

32. A wall structure comprising, in combination:

a plurality of facing blocks arranged in generally horizontal, overlapping courses, one upon the other, each facing block having a generally planar front face, side walls, a back face and generally parallel top and bottom surfaces;

each facing block including at least one throughbore through the block, and a counterbore in the top or bottom surface connected with the throughbore, said counterbore extending through the back face;

at least one block member abutted against the back face of the facing block to define a longitudinal tension member;

fastening means for attaching the block member to the facing block; and particulate material compacted over the tension members adjacent the back face to anchor the facing blocks, said particulate material stabilized, at least in part, by frictional interaction with the tension members.

33. The wall structure of claim 32 wherein the block members comprise generally parallelpiped cast blocks having throughbores, and the fastening means comprise clip members fitted into throughbores of adjacent abutting blocks.

34. An improved wall construction comprising, in combination:

a plurality of facing block members arrayed in overlapping courses one upon the other each block member having a generally planar front face, a back face, first and second side faces connecting the front face to the back face, and generally parallel top and bottom surfaces extending from the front face to the back face;

each block member also including at least two generally parallel counterbores in the bottom surface extending from adjacent the front face through the back face, and also including a cross counterbore connecting the parallel counterbores;

each block member also including at least one bore in each of the parallel counterbores extending at least partially through the block from the bottom toward the top surface;

stabilizing elements, at least some of said stabilizing elements including a pair of tension arms positioned in the counterbores of selected block members, each pair of said tension arms of each said stabilizing element being generally parallel and connected together by a cross member in the cross counterbore;

the stabilizing elements further including soil engaging means extending therefrom projecting away from the back face of each block into compacted soil; and compacted soil for receipt of the soil engaging means for engagement with the soil.

* * * * *